US009638200B2

(12) United States Patent
Tsutsui

(10) Patent No.: US 9,638,200 B2
(45) Date of Patent: May 2, 2017

(54) TURBO-MOLECULAR PUMP

(71) Applicant: SHIMADZU CORPORATION, Kyoto (JP)

(72) Inventor: Shingo Tsutsui, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 361 days.

(21) Appl. No.: 14/479,858

(22) Filed: Sep. 8, 2014

(65) Prior Publication Data

US 2015/0086328 A1 Mar. 26, 2015

(30) Foreign Application Priority Data

Sep. 24, 2013 (JP) ..... 2013-196996
Mar. 4, 2014 (JP) ..... 2014-041527

(51) Int. Cl.

| | |
|---|---|
| ***F01D 19/02*** | (2006.01) |
| ***F04D 27/00*** | (2006.01) |
| ***F04D 19/04*** | (2006.01) |
| ***F04D 27/02*** | (2006.01) |
| ***F04D 29/58*** | (2006.01) |

(52) U.S. Cl.

CPC ..... *F04D 27/006* (2013.01); *F04D 19/042* (2013.01); *F04D 27/02* (2013.01); *F04D 29/584* (2013.01)

(58) Field of Classification Search

CPC ..... F01D 11/24; F04D 29/584; F04D 29/5853
USPC ..... 415/47
See application file for complete search history.

(56) References Cited

U.S. PATENT DOCUMENTS 5,190,438 A * 3/1993 Taniyama ..... F04C 29/025 415/175
2002/0039533 A1* 4/2002 Miyamoto ..... F04D 19/04 417/313
2003/0175132 A1* 9/2003 Ishikawa ..... F04D 19/042 417/353

FOREIGN PATENT DOCUMENTS

JP 3930297 3/2007

OTHER PUBLICATIONS

English translation of Chinese Office Action dated May 26, 2016 for corresponding Chinese Application No. 201410270398.0.

* cited by examiner

*Primary Examiner* — Eric Keasel
*Assistant Examiner* — Jason Mikus
(74) *Attorney, Agent, or Firm* — Renner, Otto, Boisselle & Sklar, LLP

(57) ABSTRACT

A turbo-molecular pump comprises: a rotor having a plurality of stages of rotor blades and a cylindrical section; a plurality of stages of stationary blades alternately arranged with respect to the rotor blades; a stator arranged with a gap from the cylindrical section, the stator together with the cylindrical section constituting a screw groove pump section; a plurality of spacers stacked on a base, the spacers including at least one cooling spacer having a cooling section; a heater heating the stator; a temperature regulation section controlling the heater to regulate the temperature of the stator so as to be a reaction product accumulation prevention temperature; and an auxiliary ring for reaction product accumulation prevention at least a part of which is located in a space between the spacer facing a bottom step rotor blade, and the bottom step rotor blade.

10 Claims, 14 Drawing Sheets

TURBO-MOLECULAR PUMP

TECHNICAL FIELD

The present invention relates to a turbo-molecular pump that is provided with a cooling passage for cooling a rotor having rotor blades and a temperature regulator.

BACKGROUND ART

Conventionally, in the process of dry etching, CVD, or the like in semiconductor manufacturing processes, processing is performed while supplying a large amount of gas in order to perform the process at high speed. Generally, a turbo-molecular pump that is provided with a turbine blade section and a screw groove pump section housed inside a pump case is used in the evacuation of a process chamber in the process of dry etching, CVD, or the like. When discharging a large amount of gas by the turbo-molecular pump, frictional heat generated in moving blades (rotor blades) is transmitted from the moving blades to stator blades (stationary blades), spacers, and a base in this order, and then released into cooling water in a cooling pipe provided in the base.

However, when discharging a larger amount of gas, the temperature of a rotor that includes the moving blades may disadvantageously exceed an allowable temperature. When the temperature of the rotor exceeds the allowable temperature, the speed of expansion by creep becomes higher. As a result, in any place in the turbine blade section and the screw groove pump section, disadvantageously, the moving blades and the stator blades may make contact with each other or the rotor and a screw stator may make contact with each other within a shorter period than a designed life.

Further, in this kind of semiconductor manufacturing apparatus, a reaction product is generated in etching or CVD, and the reaction product is likely to be accumulated on the screw stator of the screw groove pump section. A gap between the screw stator and the rotor is extremely small. Therefore, when a reaction product is accumulated on the screw stator, the screw stator and the rotor may be stuck to each other. As a result, the rotor may not be able to start rotating.

Therefore, the invention described in Patent Literature 1 (JP 3930297 B1) is provided with a first cooling water passage which cools rotor blades by cooling a pump case and a device for regulating the temperature of a screw stator (a heater and a second cooling water passage). The first cooling water passage is provided on the outer peripheral surface of the pump case, and cools the pump case to thereby cool stationary blades housed inside the pump case. In this manner, by providing the first cooling water passage and the temperature regulator, the temperature of the rotor is reduced and the accumulation of a reaction product on the screw stator is suppressed.

However, along with an increase in the size of a wafer to be processed, the flow amount of gas that should be discharged by the turbo-molecular pump increases, and the amount of heat generated due to the discharge of gas also increases. Therefore, a method in which the pump case is cooled as described in Patent Literature 1 does not have enough cooling capacity to cool the stationary blades. Further, the temperature of the base to which the pump case is fixed becomes high by temperature regulation. Therefore, heat flowing to the pump case from the base is a factor that inhibits cooling of the stationary blades. Therefore, a turbo-molecular pump that has sufficient cooling capacity to cool stationary blades and can regulate the temperature so that the temperature of the screw stator is a reaction product accumulation prevention temperature is required. On the other hand, when a turbo-molecular pump has sufficient cooling capacity to cool the stationary blades and the sublimation temperature of a reaction product is higher than the cooling temperature, the reaction product may be accumulated on the inner side of a spacer that corresponds to the bottom step moving blade, and the bottom step moving blade may disadvantageously make contact with the reaction product.

SUMMARY OF THE INVENTION

A turbo-molecular pump comprises: a rotor having a plurality of stages of rotor blades and a cylindrical section; a plurality of stages of stationary blades alternately arranged with respect to the rotor blades; a stator arranged with a gap from the cylindrical section, the stator together with the cylindrical section constituting a screw groove pump section; a plurality of spacers stacked on a base, the spacers including at least one cooling spacer having a cooling section; a heater heating the stator; a temperature regulation section controlling the heater to regulate the temperature of the stator so as to be a reaction product accumulation prevention temperature; and an auxiliary ring for reaction product accumulation prevention at least a part of which is located in a space between the spacer facing a bottom step rotor blade, and the bottom step rotor blade.

The auxiliary ring is formed separately from the base and in contact with the base so that heat of the base is transferred thereto, or the auxiliary ring is integrally formed with the base or the stator.

The auxiliary ring is arranged separated from the spacer.

The auxiliary ring has a layer which is formed on a surface facing the rotor blade and increases the heat absorption.

The turbo-molecular pump further comprises: a heat source heating the auxiliary ring; a heat insulation member thermally insulating the auxiliary ring from the base; and a controller controlling the heat source independently of the heater.

The turbo-molecular pump further comprises: a spacer cooling passage provided in the cooing section of the at least one cooling spacer; and a base cooling passage cooling the base. A coolant is supplied to the spacer cooling passage, and the coolant flows into the base cooling passage through the spacer cooling passage.

A turbo-molecular pump comprises: a rotor having a plurality of stages of rotor blades and a cylindrical section; a plurality of stages of stationary blades alternately arranged with respect to the rotor blades; a stator arranged with a gap from the cylindrical section, the stator together with the cylindrical section constituting a screw groove pump section; and a plurality of spacers stacked on a base, the spacers including a bottom step cooling spacer having a cooling section. On at least one of a contact surface of the bottom step stationary blade supported by the cooling spacer, the contact surface making contact with the cooling spacer, and a contact surface of the cooling spacer, the contact surface making contact with the bottom step stationary blade, a heat resistant section suppressing heat transfer from the bottom step stationary blade to the cooling spacer is provided.

The bottom step stationary blade is formed of an aluminum alloy, and alumite treatment is applied onto a surface of the bottom step stationary blade, the surface including at least the contact surface, to form the heat resistant section, and/or the cooling spacer is formed of an aluminum alloy, and alumite treatment is applied onto a surface of the cooling spacer, the surface including at least the contact surface, to form the heat resistant section.

The heat resistant section provided on the contact surface of the bottom step stationary blade or the contact surface of the cooling spacer is formed of a resin material.

The turbo-molecular pump further comprises: a heater heating the stator; a temperature regulation section controlling the heater to regulate the temperature of the stator so as to be a reaction product accumulation prevention temperature; a spacer cooling passage provided in the cooling section of the cooling spacer; and a base cooling passage cooling the base. A coolant is supplied to the base cooling passage, and the coolant flows into the spacer cooling passage through the base cooling passage.

The present invention makes it possible to provide the turbo-molecular pump that prevents the rotor blades from colliding with a reaction product while efficiently cooling the spacers and regulating the temperature of the stator in the screw groove pump section to improve the exhaust flow amount.

DETAILED DESCRIPTION OF THE EXEMPLARY EMBODIMENTS

First Embodiment

Figure 1:
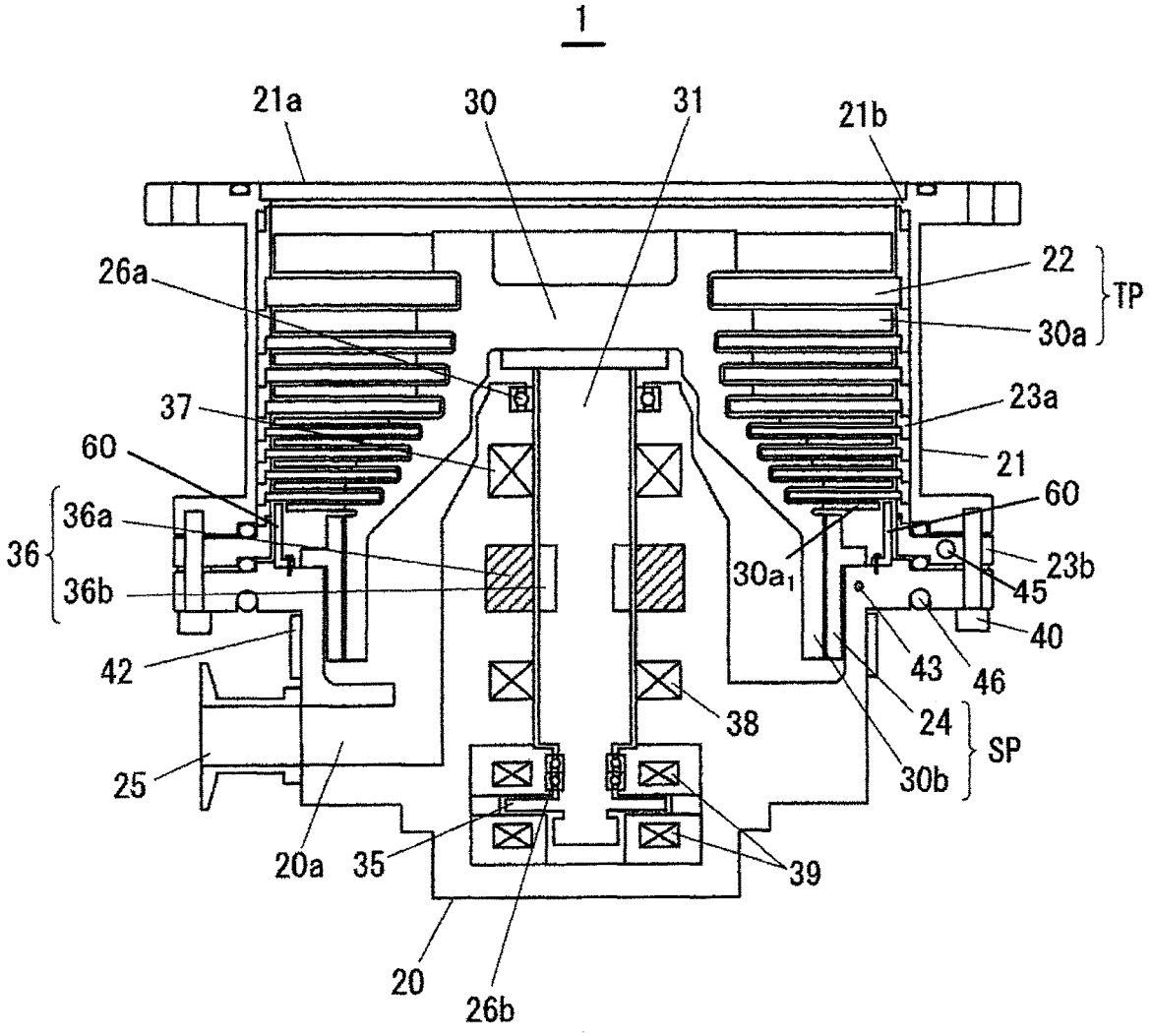
FIG. 1 is a cross-sectional view illustrating a first embodiment of a turbo-molecular pump according to the present invention.

Hereinbelow, an embodiment of a turbo-molecular pump of the present invention will be described with reference to the drawings. The turbo-molecular pump is provided with a turbine blade section and a screw groove pump section housed inside a pump case. FIG. 1 is a diagram illustrating the schematic configuration of the turbo-molecular pump according to the present invention. The turbo-molecular pump includes a pump main body 1 and a control unit (not illustrated, and described below) which controls the drive of the pump main body 1. The control unit is provided with a main controller which controls the entire pump main body 1, a motor controller which drives a motor 36, a bearing controller which controls magnetic bearings provided in the pump main body 1, a temperature regulation controller 511 (described below, see FIG. 4), and the like.

In the following description, an active magnetic bearing type turbo-molecular pump will be described as an example. However, the present invention can also be applied to a turbo-molecular pump provided with a passive magnetic bearing using a permanent magnet and a turbo-molecular pump using a mechanical bearing.

In a rotor 30, a plurality of stages of rotor blades 30*a* and a cylindrical section 30*b* which is provided on an exhaust downstream side with respect to the rotor blades 30*a*. The rotor 30 is fastened to a shaft 31 as a rotor shaft. The rotor 30 and the shaft 31 constitute a pump rotor body. The shaft 31 is supported in a contactless manner by magnetic bearings 37, 38, and 39 which are provided in a base 20. Electromagnets of the axial magnetic bearing 39 are arranged so as to sandwich a rotor disc 35 provided on the lower end of the shaft 31 in the axial direction.

The pump rotor body (the rotor 30 and the shaft 31) which is magnetically levitated in a freely rotatable manner by the magnetic bearings 37 to 39 is driven to rotate at high speed by the motor 36. For example, a three-phase brushless motor is used as the motor 36. A motor stator 36*a* of the motor 36 is provided in the base 20, and a motor rotor 36*b* which is provided with a permanent magnet is coupled to the shaft 31. Emergency mechanical bearings 26*a* and 26*b* support the shaft 31 when the magnetic bearings are not operating.

Figure 5:
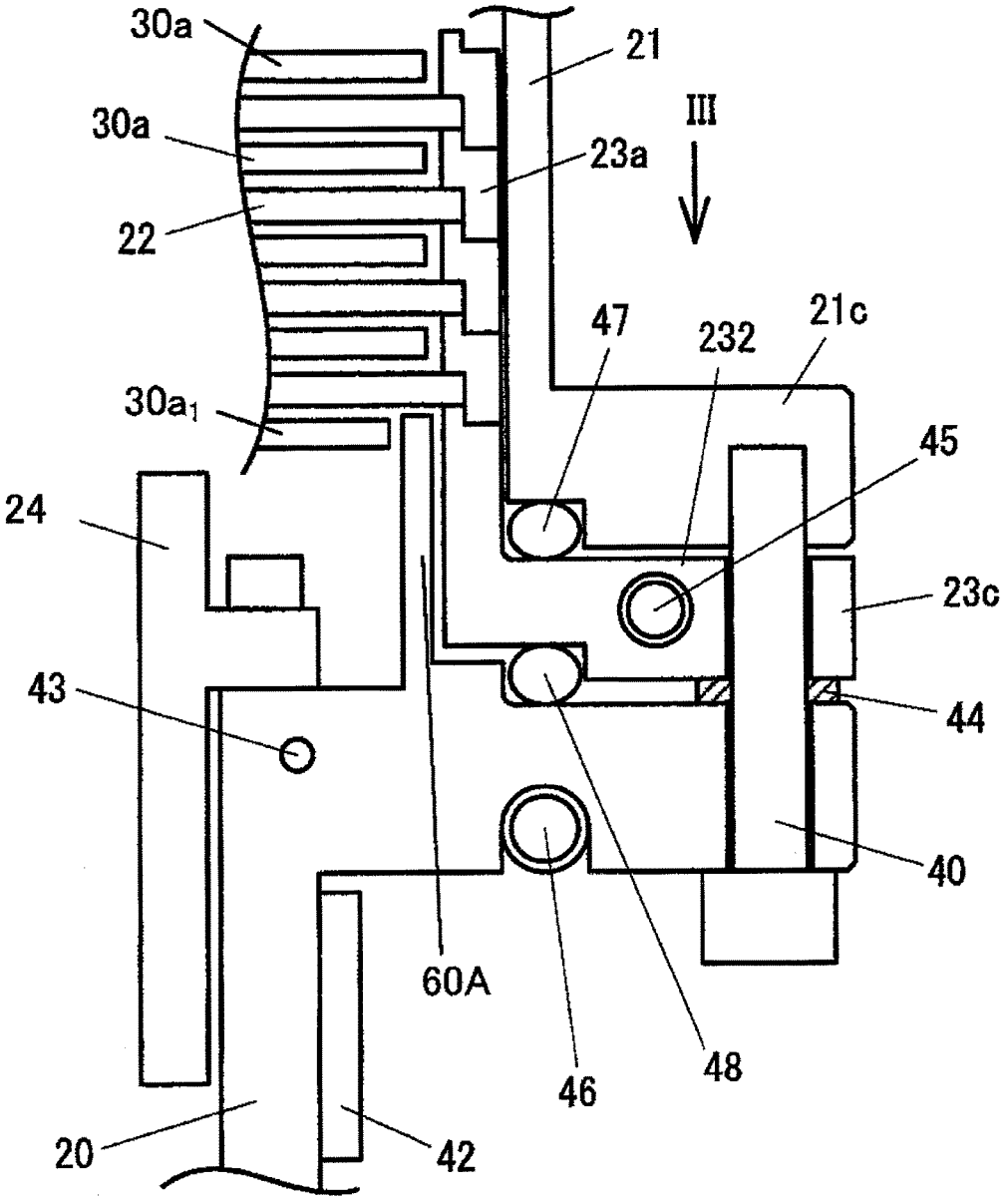
FIG. 5 is an enlarged view of an area in which a cooling spacer and an auxiliary ring are arranged in a second embodiment of the present invention.

A plurality of stages of stationary blades 22 are arranged between the respective stages of rotor blades 30*a* which are vertically adjacent to each other. The stationary blades 22 are sandwiched by a plurality of spacers 23*a*, and positioned on the base 20 by a cooling spacer 23*b*. In the turbo-molecular pump of the first embodiment, a plurality of spacers which positions the stationary blades 22 on the base 20 includes the cylindrical spacers 23*a* and the cylindrical cooling spacer 23*b* which bears the spacers 23*a* and has a flange. As illustrated in FIG. 5 (described later), the cooling spacer 23*b* and the lowest spacer 23*a* which is arranged above the cooling spacer 23*b* may be integrated with each other to from a cooling spacer 23*c*.

When the case 21 is fixed to the base 20 with bolts 40, a stacked body of the stationary blades 22, the spacers 23*a*, and the cooling spacer 23*b* is fixed to the base 20 so as to be sandwiched between an upper end locking section 21*b* of the case 21 and the base 20. As a result, the stationary blades 22 are positioned in the axial direction (vertical direction in the drawing).

The turbo-molecular pump illustrated in FIG. 1 is provided with a turbine blade section TP which includes the rotor blades 30*a* and the stationary blades 22 and a screw groove pump section SP which includes the cylindrical section 30*b* and a screw stator 24. Here, the structure in which a screw groove is formed on the screw stator 24 is described as an example. However, the screw groove may be formed on the cylindrical section 30*b*. An exhaust port 25 is provided in an exhaust opening 20*a* of the base 20. A back pump (not illustrated) is connected to the exhaust port 25. By driving the rotor 30 to rotate at high speed by the motor 36 while magnetically levitating the rotor 30, gas molecules in a suction port 21*a* are discharged toward the exhaust port 25.

In the base 20, a base cooling pipe 46, a heater 42, and a temperature sensor 43 for controlling the temperature of the screw stator 24 are provided. A coolant such as cooling water flows inside the base cooling pipe 46, and abase cooling passage is thereby formed. The temperature of the screw stator 24 is regulated so as to prevent the accumulation of a reaction product. The temperature regulation will be described below. The heater 42 which includes a band heater is wound around the side face of the base 20. Instead of this structure, a sheathed heater may be embedded in the base 20, or provided in the screw stator 24. As the temperature sensor 43, for example, a thermistor or a thermocouple is used.

A spacer cooling pipe 45 is provided in a flange section 232 of the cooling spacer 23*b*. In the turbo-molecular pump of the present embodiment, a heat transfer ring 60 is arranged on the upper surface of the base 20 on the inner side of the cooling spacer 23*b*. The tip of the heat transfer ring 60 extends up to a position between the bottom step spacer 23*a* and the bottom step rotor blade 30*a*1. The heat transfer ring 60 will be described in detail with reference to FIGS. 2 and 3.

Figure 2:
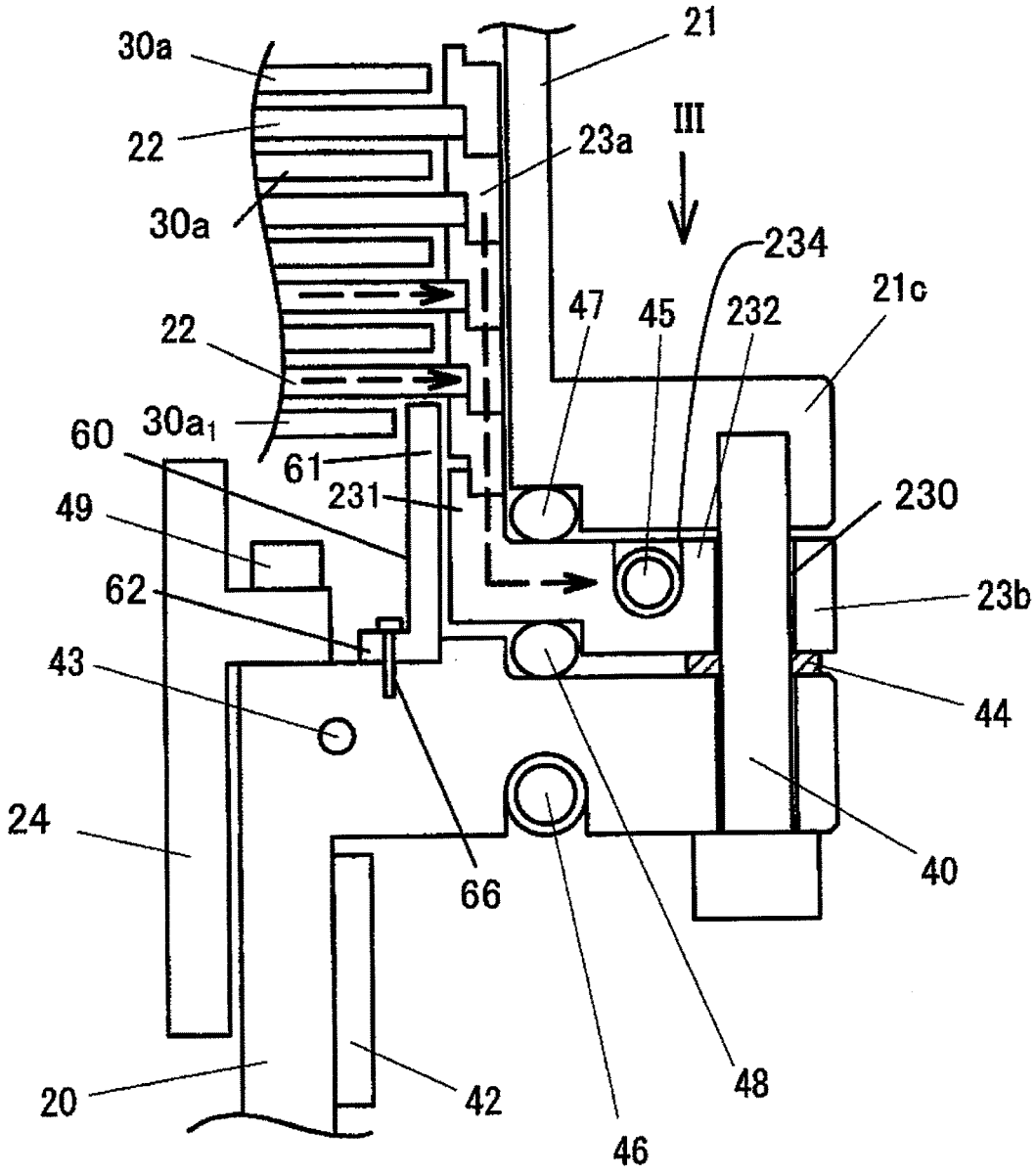
FIG. 2 is an enlarged view of an area in which a cooling spacer and an auxiliary ring are arranged in FIG. 1.
Figure 3:
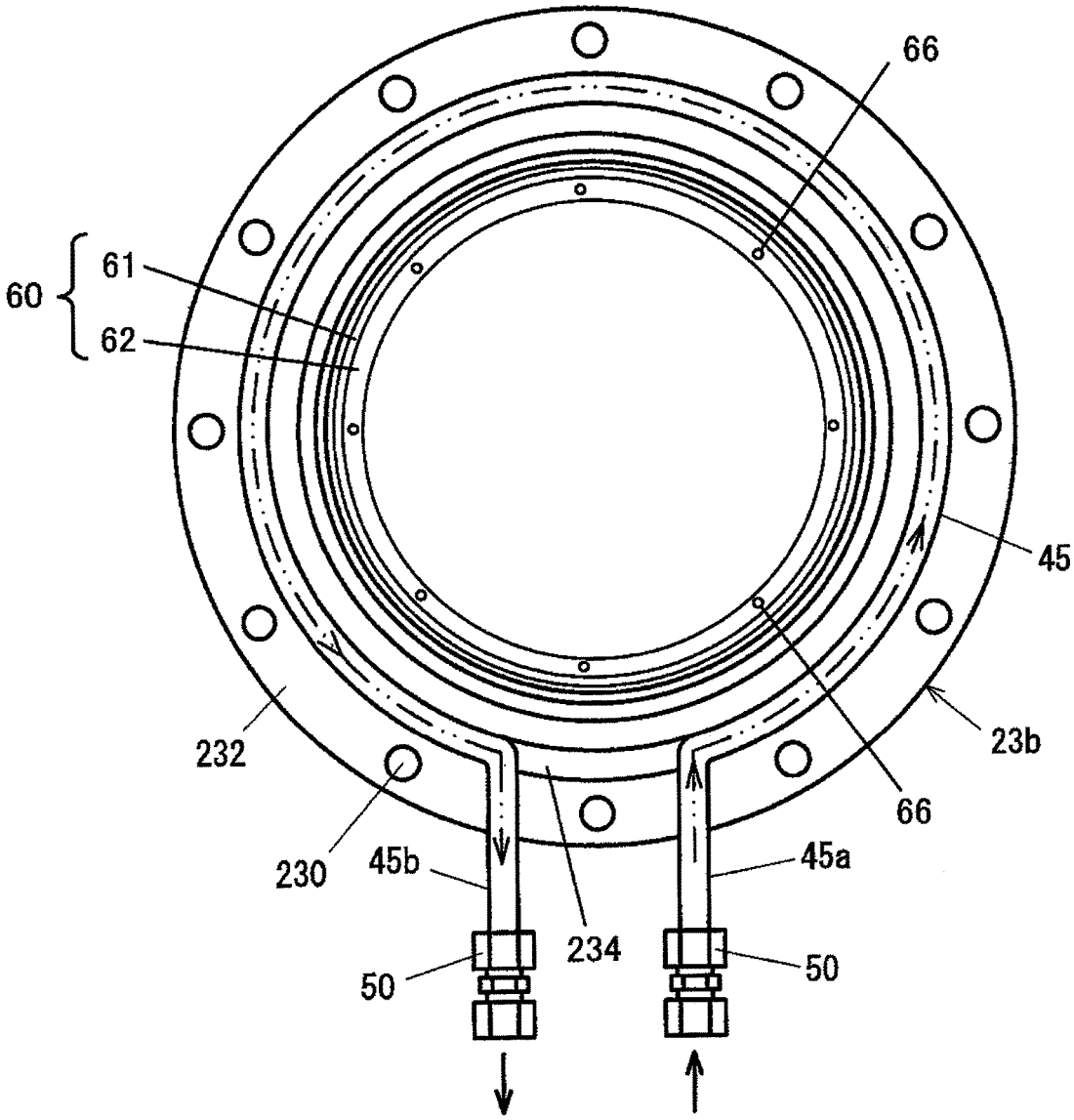
FIG. 3 is a diagram of the cooling spacer and the vicinity thereof viewed from the direction of III in FIG. 2.

FIG. 2 is an enlarged view of an area in which the cooling spacer 23*b* and the heat transfer ring 60 are arranged in FIG. 1. FIG. 3 is a diagram of the cooling spacer 23*b* and the vicinity thereof viewed from the direction of III of FIG. 2. As described above, the stacked body formed by alternately stacking the stationary blades 22 and the spacers 23*a* on each other is mounted on the cooling spacer 23*b*. The cooling spacer 23*b* is provided with the flange section 232 in which the spacer cooling pipe 45 is provided and a ring-like spacer section 231 which bears the bottom step spacer 23*a*.

As with the spacers 23*a*, the spacer section 231 is a ring-like component. A groove 234 which has an annular shape in a plan view is formed on the flange section 232 which extends toward the atmospheric side from the spacer section 231 as illustrated in FIG. 3. The groove 234 has an arc-like bottom face, and the spacer cooling pipe 45 is attached in contact with the bottom face. A coolant such as cooling water flows inside the spacer cooling pipe 45, and a spacer cooling passage is thereby formed. A plurality of through holes 230 for bolt fastening are formed along the circumferential direction on the outer peripheral side of the groove 234. A gap between the spacer cooling pipe 45 and the groove 234 is filled with thermal conductive grease, high thermal conductive resin, solder, or the like. The thermal conductivity of grease and resin is approximately 1 W/mK. On the other hand, the thermal conductivity of solder is 50 W/mK. Therefore, heat can be efficiently transferred.

Both ends of the spacer cooling pipe 45 are bent, so that a coolant supply section 45*a* and a coolant discharge section 45*b* are extracted to the side of the cooling spacer 23*b*. A piping joint 50 is attached to each of the coolant supply section 45*a* and the coolant discharge section 45*b*. A coolant flows into the spacer cooling pipe 45 from the coolant supply section 45*a*, then circularly flows along the spacer cooling pipe 45, and is then discharged from the coolant discharge section 45*b*.

The case 21 is attached so that a flange 21*c* faces the flange section 232 of the cooling spacer 23*b*, and fixed to the base 20 with the bolts 40. Heat insulation washers 44 each of which functions as a heat insulation member are provided in the respective bolts 40. The heat insulation washers 44 are arranged between the base 20 and the cooling spacer 23*b* to thermally insulate the base 20 and the cooling spacer 23*b* from each other. As the material used in the heat insulation washers 44, a material having a thermal conductivity that is lower than the thermal conductivity of the material used in the spacers 23*a* and the cooling spacer 23*b* (an aluminum alloy, for example) is used. For example, a stainless alloy or the like is desirably used among metal, and a resin having a heat resistant temperature of 120° or higher (an epoxy resin, for example) is desirably used among nonmetal.

A vacuum seal 48 is provided between the flange section 232 of the cooling spacer 23*b* and the base 20. Also, a vacuum seal 47 is provided between the flange section 232 and the flange 21*c*. The screw stator 24 is fixed to the base 20 with bolts 49. The base 20 is heated by the heater 42, and cooled by the base cooling pipe 46 in which a coolant flows. The temperature sensor 43 is arranged on the base 20 at a position near a part to which the screw stator 24 is fixed.

The heat transfer ring 60 described above is arranged on the upper surface of the base 20 on the vacuum inner face side of the cooling spacer 23*b* so as to be concentric with a rotor axial center. The heat transfer ring 60 includes a ring main body 61 and a flange-like attachment section 62 which is formed on the bottom of the ring main body 61 in a bent manner, and has a generally L-shaped cross section. The heat transfer ring 60 is fixed to the upper surface of the base 20 with bolts 66 at a plurality of positions in the circumferential direction. The attachment section 62 of the heat transfer ring 60 abuts on the upper surface of the base 20, so that heat of the base 20 is transferred to the heat transfer ring 60. The ring main body 61 of the heat transfer ring 60 faces the inner surface of the bottom step spacer 23*a* and the inner surface of the cooling spacer 23*b* so as to cover these surfaces. Further, the ring main body 61 is separated from the inner surface of the bottom step spacer 23*a* and the inner surface of the cooling spacer 23*b*.

The tip of the ring main body 61 of the heat transfer ring 60 extends up to a position above a vacuum side tip of the cooling spacer 23*b*. More specifically, the length of the bottom step rotor blade 30*a*1 is shorter than the length of the other rotor blades 30*a*. Further, the tip of the ring main body 61 of the heat transfer ring 60 extends beyond a space in which the tip of the bottom step rotor blade 30*a*1 and the bottom step spacer 23*a* face each other.

When the coolant for cooling the cooling spacer 23*b* is water, the temperature of the vacuum side surface of the cooling spacer 23*b* is 20° C. to 30° C. When the sublimation temperature of a reaction product is higher than the temperature of the vacuum side surface of the cooling spacer 23*b*, the reaction product may be accumulated on the inner side of the cooling spacer 23*b*. Similarly, when the bottom step spacer 23*a* is cooled until the temperature of the vacuum side surface thereof becomes lower than the sublimation temperature of a reaction product, the reaction product may be accumulated on the inner side of the spacer 23*a*. Therefore, the bottom step rotor blade 30*a*1 may disadvantageously make contact with the reaction product accumulated on the vacuum side surface of the spacer 23*a* or the cooling spacer 23*b* which faces the bottom step blade 30*a*1.

Therefore, in the present invention, the heat transfer ring 60 is interposed between the bottom step rotor blade 30*a*1 and the spacer 23*a* or the cooling spacer 23*b*. The heat transfer ring 60 is heated to a temperature equal to or higher than the sublimation temperature of a reaction produce by heat transferred from the base 20. As a result, the accumulation of the reaction product on the inner peripheral surface of the heat transfer ring 60 is prevented. Since the inner peripheral surface of the bottom step spacer 23*a* and the inner peripheral surface of the cooling spacer 23*b* are heated by the heat transfer ring 60, a reaction production is less likely to be accumulated on these inner peripheral surfaces. Even when the bottom step spacer 23*a* is not sufficiently heated up to the sublimation temperature and a reaction product is therefore accumulated on the inner peripheral surface thereof, since the inner peripheral surface of the bottom step spacer 23*a* does not directly face the bottom step rotor blade 30*a*1 by virtue of the heat transfer ring 60, the rotor blade 30*a*1 does not collide with the accumulated reaction product. In this manner, the heat transfer ring 60 is auxiliarily placed for the purpose of preventing the accumulation of a reaction product, and can also be referred to as an auxiliary ring for reaction product accumulation prevention.

The heat transfer ring 60 can be formed of an aluminum alloy or SUS (stainless alloy). Further, the heat transfer ring 60 can be heated using radiant heat from the rotor blades 30*a* in addition to heat transferred from the base 20. In order to achieve this, a layer having high heat absorption such as an alumite layer and a black nickel plating layer may be formed on a surface of the ring main body 61 of the heat transfer ring 60, the surface facing the rotor blade 30*a*1.

The cooling spacer 23*b* is used for cooling the stationary blades 22. The cooling spacer 23*b* is cooled by a coolant flowing inside the spacer cooling pipe 45. Therefore, heat of the stationary blades 22 is transferred to the spacers 23*a* and then to the cooling spacer 23*b* as indicated by broken line arrows and released into the coolant inside the spacer cooling pipe 45. On the other hand, when discharging gas producing a reaction product that is likely to be accumulated, heating performed by the heater 42 and cooling performed by the base cooling pipe 46 are controlled to make the temperature of the screw stator 24 equal to or higher than a temperature that does not cause the accumulation of the reaction product. As the temperature that does not cause the accumulation of a reaction product, a temperature equal to or higher than the sublimation temperature of the reaction product is employed.

Therefore, the heat insulation washers 44 are arranged between the cooling spacer 23*b* and the base 20 so as to prevent heat from flowing to the stationary blades 22 from the base 20 in a high temperature state. Further, as can be seen from FIG. 2, a gap is formed between the cooling spacer 23*b* and the flange 21*c*. Therefore, heat does not flow from the case 21 to the cooling spacer 23*b*.

Figure 4:
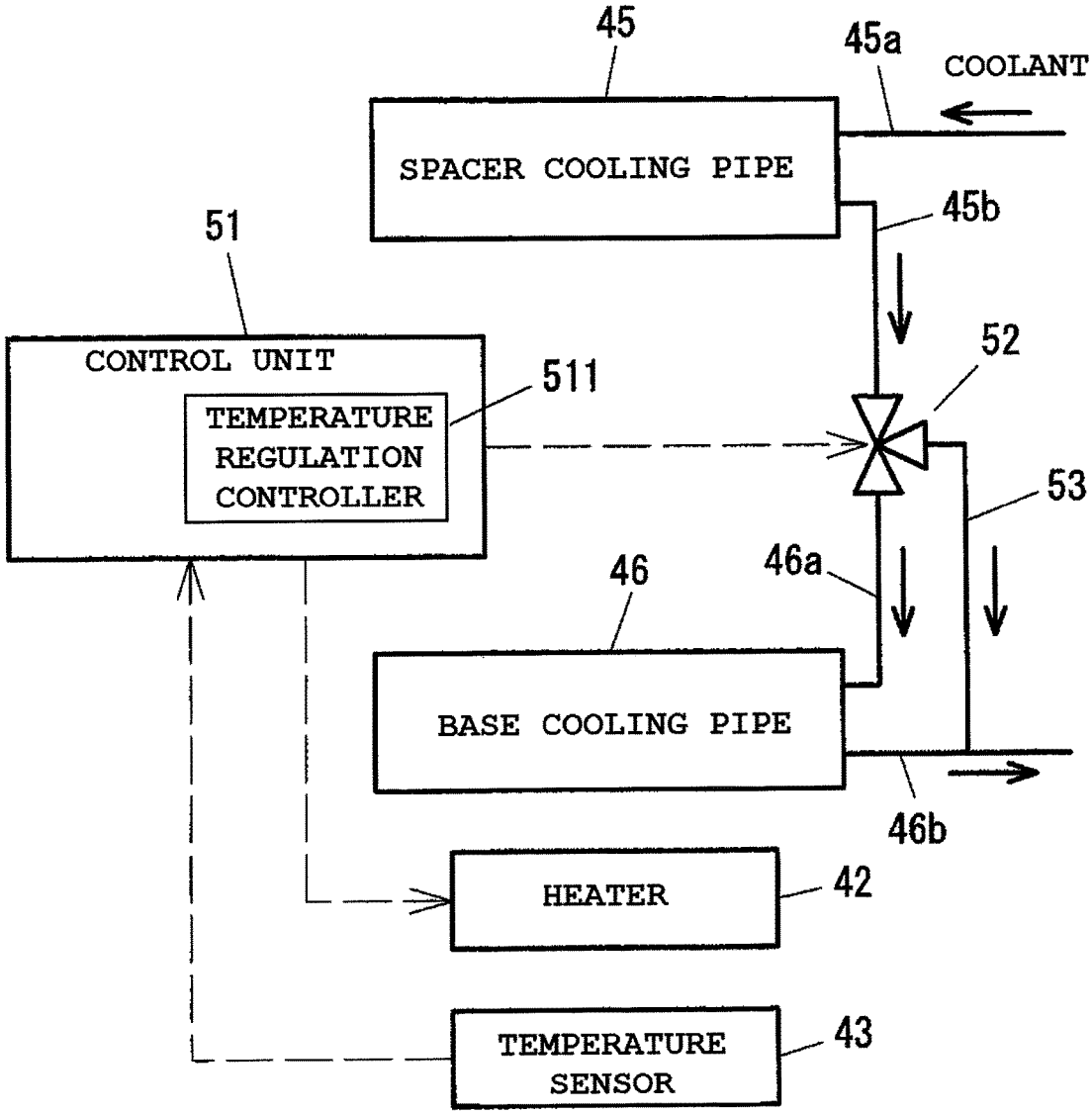
FIG. 4 is a diagram explaining a temperature regulation operation.

FIG. 4 is a diagram explaining a cooling piping system and a temperature regulation operation. The coolant discharge section 45*b* of the spacer cooling pipe 45, a coolant supply section 46*a* of the base cooling pipe 46, and a bypass pipe 53 are connected to a three-way valve 52. An end of the bypass pipe 53, the end not being connected to the three-way valve 52, is connected to a coolant discharge section 46*b* of the base cooling pipe 46. The switching of the three-way valve 52 is controlled by the temperature regulation controller 511 of a control unit 51 which controls the drive of the pump main body 1. The temperature regulation controller 511 controls the switching of the three-way valve 52 and ON/OFF of the heater 42 on the basis of a temperature detected by the temperature sensor 43.

When a temperature detected by the temperature sensor 43 is less than a predetermined temperature, the temperature regulation controller 511 switches the outflow side of the three-way valve 52 to the bypass pipe 53 to bypass a coolant from the three-way valve 52 to the coolant discharge section 46*b*. Further, the heater 42 is turned ON. As a result, the base 20 is heated by the heater 42, and the temperature of the base 20 and the temperature of the screw stator 24 thereby increase. As the temperature of the base 20 increases, the temperature of the heat transfer ring 60 to which heat from the base 20 is transferred also increases and is maintained at the same temperature as the base 20.

The predetermined temperature is equal to or higher than the sublimation temperature of the reaction product, and previously stored in a storage section (not illustrated) in the temperature regulation controller 511. In the example illustrated in FIG. 2, the temperature sensor 43 is provided in the base 20. Therefore, the predetermined temperature is set by taking a difference in temperature between apart in which the temperature sensor 43 is provided and the screw stator 24 into consideration.

When a temperature detected by the temperature sensor 43 is equal to or higher than the predetermined temperature, the temperature regulation controller 511 turns OFF the heater 42 and switches the outflow side of the three-way valve 52 to the coolant supply section 46*a* of the base cooling pipe 46 to thereby supply the coolant to the base cooling pipe 46. By performing such temperature regulation control by the temperature regulation controller 511, the screw stator 24 is maintained at a temperature equal to or higher than the sublimation temperature of the reaction product, thereby making it possible to prevent the accumulation of the reaction product.

On the other hand, since the coolant is constantly supplied to the spacer cooling pipe 45, the stationary blades 22 are maintained at a low temperature by the cooling spacer 23*b*. As a result, the heat release from the rotor blades 30*a* to the stationary blades 22 by radiation is accelerated, which makes it possible to maintain the rotor 30 at a lower temperature than a conventional one. As a result, it is possible to increase the exhaust flow amount.

In the present embodiment, giving a priority to a reduction in the rotor temperature, a coolant supply source is connected to the coolant supply section 45*a* of the spacer coolant pipe 45, and the base cooling pipe 46 is connected to the coolant discharge section 45*b* of the spacer cooling pipe 45. For example, when the spacer cooling pipe 45 is arranged on the downstream side of the base cooling pipe 46, a coolant heated by the base cooling is supplied to the spacer cooling pipe 45. When cooling the rotor 30 by cooling the stationary blades 22 by the spacer cooling pipe 45, a lower temperature is more preferred as the temperature of a coolant flowing in the spacer cooling pipe 45. Therefore, in order to improve the effect of the rotor temperature reduction, it is preferred to provide the base cooling pipe 46 on the downstream side of the spacer cooling pipe 45. By improving the effect of the rotor temperature reduction, it is possible to cope with a larger gas flow amount.

As described above, the turbo-molecular pump of the present embodiment can achieve the following effects.

(1) The spacer cooling pipe 45 is provided in one of the spacers for positioning the stationary blades 22, that is, in the cooling spacer 23*b*, and the cooling spacer 23*b* is cooled by a coolant flowing inside the spacer cooling pipe 45. Further, the heat insulation washers 44 are arranged between the cooling spacer 23*b* arranged on the base 20 and the base 20 to thereby prevent heat from flowing to the cooling spacer 23*b* from the base 20 which is in a high temperature state by the temperature regulation. Therefore, it is possible to effectively perform the cooling of the stationary blades 22 and the heating of the screw stator 24 by the temperature regulation.

As a result, it is possible to increase the exhaust flow amount and prevent the accumulation of the reaction product on the screw stator 24.

(2) The heat transfer ring 60 is placed on the base 20 to be temperature-regulated. The heat transfer ring 60 is arranged so that the outer peripheral surface of the ring 60 faces the vacuum side inner surface of the bottom step spacer 23*a* and the vacuum side inner surface of the cooling spacer 23*b* with a predetermined gap therebetween. Heat is transferred to the heat transfer ring 60 from the base 20, and the inner peripheral surface of the heat transfer ring 60 is heated to a temperature equal to or higher than the sublimation temperature of the reaction product. Therefore, the reaction product is not accumulated on the inner peripheral surface of the heat transfer ring 60. Further, it is possible to prevent the reaction product from being accumulated on the vacuum side inner surface of the bottom step spacer 23*a* and the vacuum side inner surface of the cooling spacer 23*b*.

(3) The heat transfer ring 60 is fixed to the upper side of the base 20 with the bolts 66, so that heat of the base 20 is transferred to the heat transfer ring 60. Therefore, a heat source for heating the heat transfer ring 60 is not required, and the cost can be reduced.

(4) The tip of the heat transfer ring 60 extends to a gap between the tip of the bottom step rotor blade 30*a*1 and the bottom step spacer 23*a*, the gap being located higher than the tip of the cooling spacer 23*b*. That is, the heat transfer ring 60 covers the entire area of the vacuum side inner surface of the bottom step spacer 23*a* and the entire area of the vacuum side inner surface of the cooling spacer 23*b*. The heat transfer ring 60 is heated by heat transferred from the base 20, and a reaction product is not accumulated on the surface thereof. Therefore, even when the bottom step spacer 23*a* and the cooling spacer 23*b* are cooled to a temperature lower than the sublimation temperature of the reaction product, the tip of the bottom step rotor blade 30*a*1 is prevented from colliding with the reaction product accumulated on the spacer 23*a* or the cooling spacer 23*b* as in a conventional one.

(5) When a layer having high heat absorption such as an alumite layer and a black nickel plating layer is formed on the surface of the ring main body 61 of the heat transfer ring 60, the surface facing the rotor blade 30*a*1, the heat transfer ring 60 can be heated using radiant heat from the rotor blades 30*a*1 in addition to heat transferred from the base 20. As a result, it is possible to more effectively increase the temperature of the heat transfer ring 60.

The second to fifth embodiments will be described with reference to FIGS. 5 to 8. In the second to fifth embodiments, an embedded type cooling pipe 45 of a cooling spacer is shown.

Second Embodiment

FIG. 5 is an enlarged view of an area in which a cooling spacer and an auxiliary ring are arranged as the second embodiment of the present invention.

The second embodiment illustrated in FIG. 5 differs from the first embodiment in the following structure.

(a1) A cooling spacer 23*c* has a structure obtained by integrating the cooling spacer 23*b* illustrated in FIG. 2 and the bottom step spacer 23*a* arranged above the cooling spacer 23*b* with each other. In other words, the bottom step spacer 23*a* serves as the cooling spacer 23*c*.

In a turbo-molecular pump of the second embodiment, a plurality of spacers for positioning stationary blades 22 on a base 20 includes a plurality of spacers 23*a* and the cooling spacer 23*c* which bears the spacers 23*a* while supporting the bottom step stationary blade 22.

(a2) A heat transfer ring 60A is integrally formed with the base 20. Therefore, in this structure, it is not necessary to manufacture a heat transfer ring as a separate member. Both of the heat transfer ring 60A and the base 20 may be formed of the same material such as SUS, or may also be formed of a clad material of different kinds of metal including an aluminum alloy for the heat transfer ring 60A and SUS for the base 20. Further, although not illustrated, a ring-like projection is integrally formed with the upper end of the base 20 which is made of metal such as SUS on the inner side of a heat transfer ring 60A to be formed, and a heat transfer ring 60A which is made of an aluminum alloy or the like as a separate member is integrated with the projection by shrinkage fitting.

As with the first embodiment, a layer having high heat absorption such as an alumite layer and a black nickel plating layer may be formed on a surface of the heat transfer ring 60A, the surface facing the rotor blade 30*a*1. The other configurations in the second embodiment are the same as those of the first embodiment. Therefore, the corresponding members will be denoted by the same reference sign, and description thereof will be omitted.

Also in the second embodiment, the same effects as in the first embodiment can be achieved. In the second embodiment, the tip of the heat transfer ring 60A is lower than the vacuum side tip of the cooling spacer 23*c*. However, the tip of the rotor blade 30*a*1 faces the inner peripheral surface of the heat transfer ring 60A and the heat transfer ring 60A is heated to a temperature equal to or higher than the sublimation temperature of generated gas. Therefore, a reaction product is not accumulated on the inner peripheral surface of the heat transfer ring 60, and there is no possibility of the rotor blade 30*a*1 colliding with the accumulated reaction product. Further, since the cooling spacer 23*c* is integrated with the bottom step spacer 23*a*, cost reduction achieved by a reduction in the number of components can be expected.

Third Embodiment

Figure 6:
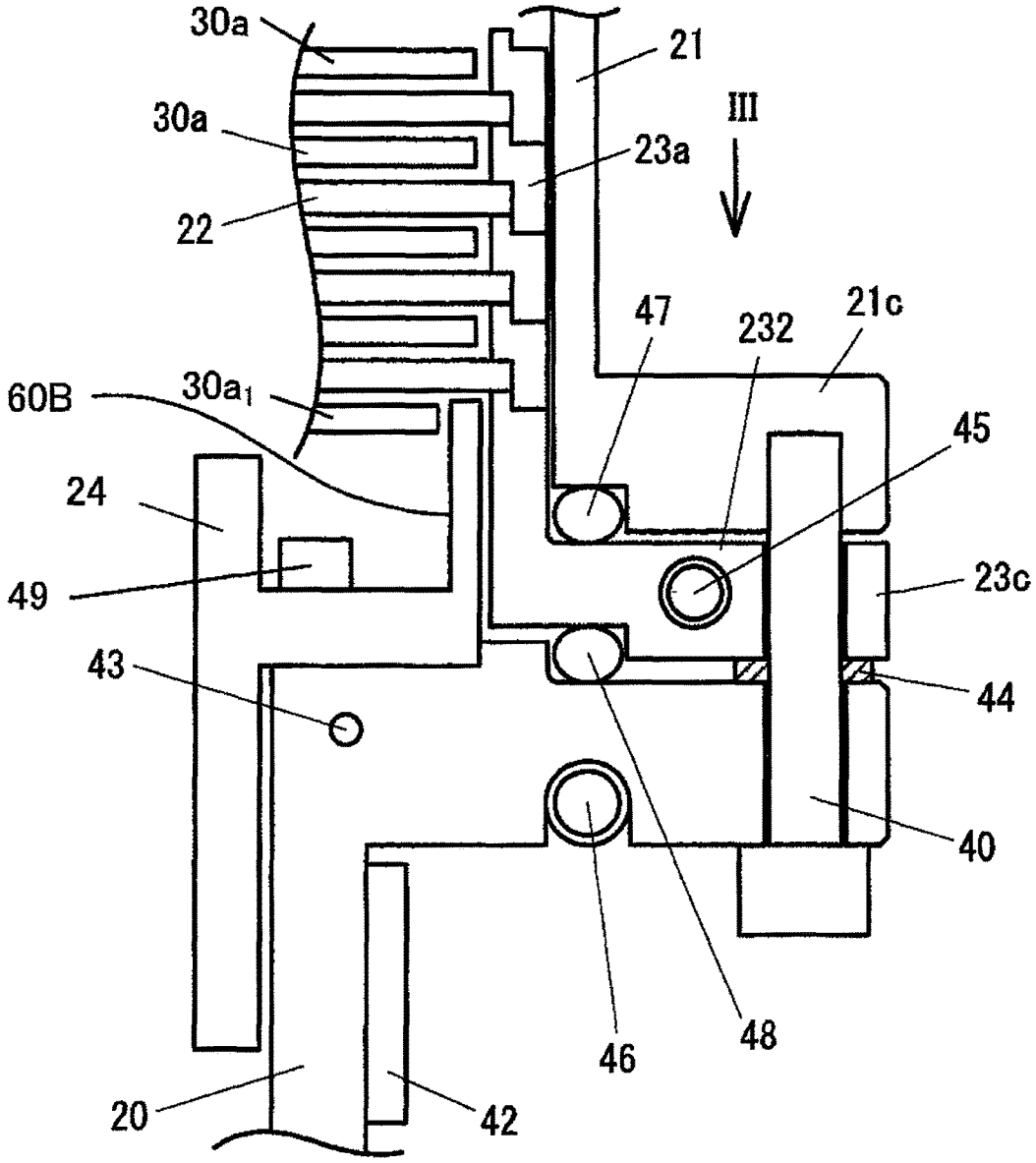
FIG. 6 is an enlarged view of an area in which a cooling spacer and an auxiliary ring are arranged in a third embodiment of the present invention.

FIG. 6 is an enlarged view of an area in which a cooling spacer and an auxiliary ring are arranged as the third embodiment of the present invention. The third embodiment illustrated in FIG. 6 differs from the second embodiment in the following structure.

(b1) A heat transfer ring 60B is integrally formed with a screw stator 24.

An attachment section of the screw stator 24, the attachment section being attached to a base 20, extends toward the outer peripheral side, and is bent upward on an end part thereof to form the heat transfer ring 60B. As with the first embodiment, the screw stator 24 is fixed to the base 20 with bolts 49. Accordingly, heat of the base 20 is transferred to the heat transfer ring 60B.

In a turbo-molecular pump of the third embodiment, a plurality of spacers for positioning stationary blades 22 on the base 20 includes a plurality of spacers 23*a* and a cooling spacer 23*c* which bears the spacers 23*a* while supporting the bottom step stationary blade 22.

As with the first embodiment, a layer having high heat absorption such as an alumite layer and a black nickel plating layer may be formed on a surface of the heat transfer ring 60B, the surface facing the rotor blade 30*a*1. The other configurations in the third embodiment are the same as those of the second embodiment. Therefore, the corresponding members will be denoted by the same reference sign, and description thereof will be omitted.

Fourth Embodiment

Figure 7:
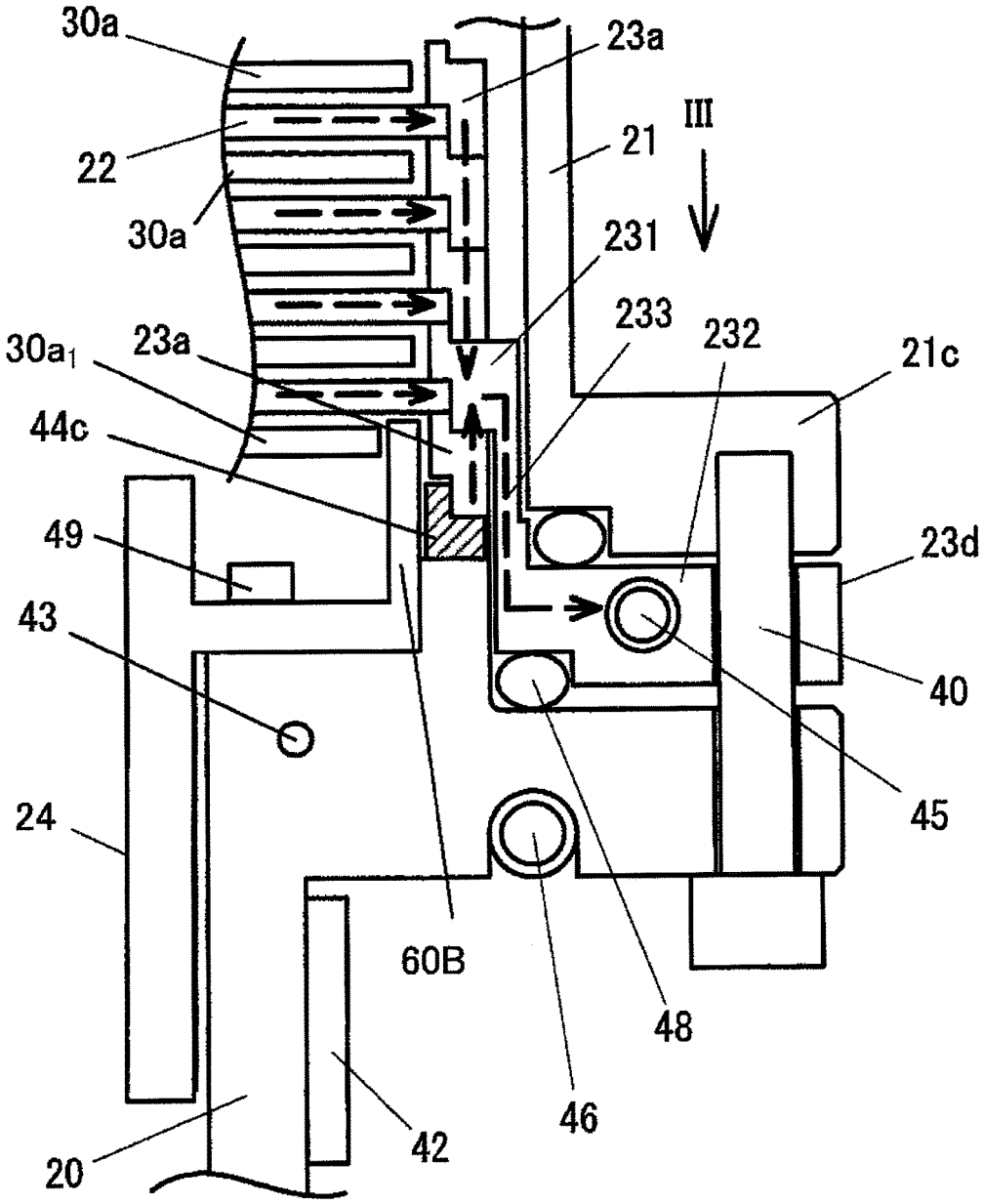
FIG. 7 is an enlarged view of an area in which a cooling spacer and an auxiliary ring are arranged in a fourth embodiment of the present invention.

FIG. 7 is an enlarged view of an area in which a cooling spacer and an auxiliary ring are arranged as the fourth embodiment of the present invention. The fourth embodiment illustrated in FIG. 7 differs from the first embodiment in the following structure.

(c1) The second spacer from a base 20 is used as a cooling spacer 23*d*. The cooling spacer 23*d* includes a spacer section 231 which functions as a spacer, a flange section 232 in which a spacer cooling pipe 45 is provided, and a cylindrical coupling section 233 which couples the spacer section 231 and the flange section 232 to each other.

In a turbo-molecular pump of the fourth embodiment, a plurality of spacers for positioning stationary blades 22 on the base 20 includes a plurality of spacers 23*a* and the cooling spacer 23*d* which bears the spacers 23*a* excepting the bottom step spacer 23*a* while supporting the bottom step stationary blade 22 and the second stationary blade 22 from the bottom.

The plurality of stages of stationary blades 22 are positioned by the spacers 23*a* and the spacer section 231. Therefore, a ring-like heat insulation member 44*c* is arranged between the first spacer 23*a* from the base 20 and the base 20. Further, a gap is formed between the flange section 232 and the base 20 without providing a heat insulation member therebetween. That is, a heat insulation layer of air is formed between the flange section 232 and the base 20. Heat of the stationary blades 22 and the spacers 23*a* is transferred to the spacer section 231 of the cooling spacer 23*d* as indicated by broken line arrows, and released into a coolant inside the spacer cooling pipe 45 through the coupling section 233 and the flange section 232. In the fourth embodiment, the inner peripheral surface of the cooling spacer 23*d* does not directly face the rotor blade 30*a*1.

(c2) A heat transfer ring 60B is integrally formed with a screw stator 24.

An attachment section of the screw stator 24, the attachment section being attached to the base 20, extends toward the outer peripheral side, and is bent upward on an end part thereof to form the heat transfer ring 60B. As with the first embodiment, the screw stator 24 is fixed to the base 20 with bolts 49. Accordingly, heat of the base 20 is transferred to the heat transfer ring 60B.

As with the first embodiment, a layer having high heat absorption such as an alumite layer and a black nickel plating layer may be formed on a surface of the heat transfer ring 60B, the surface facing the rotor blade 30*a*1. The other configurations in the fourth embodiment are the same as those of the first embodiment. Therefore, the corresponding members will be denoted by the same reference sign, and description thereof will be omitted.

Also in the fourth embodiment, the same effects as in the first embodiment can be achieved. In the fourth embodiment, each of the bolts 49 is used to fix both of the screw stator 24 and the heat transfer ring 60B to the base 20. Therefore, assembling man hours can be reduced.

Fifth Embodiment

Figure 8:
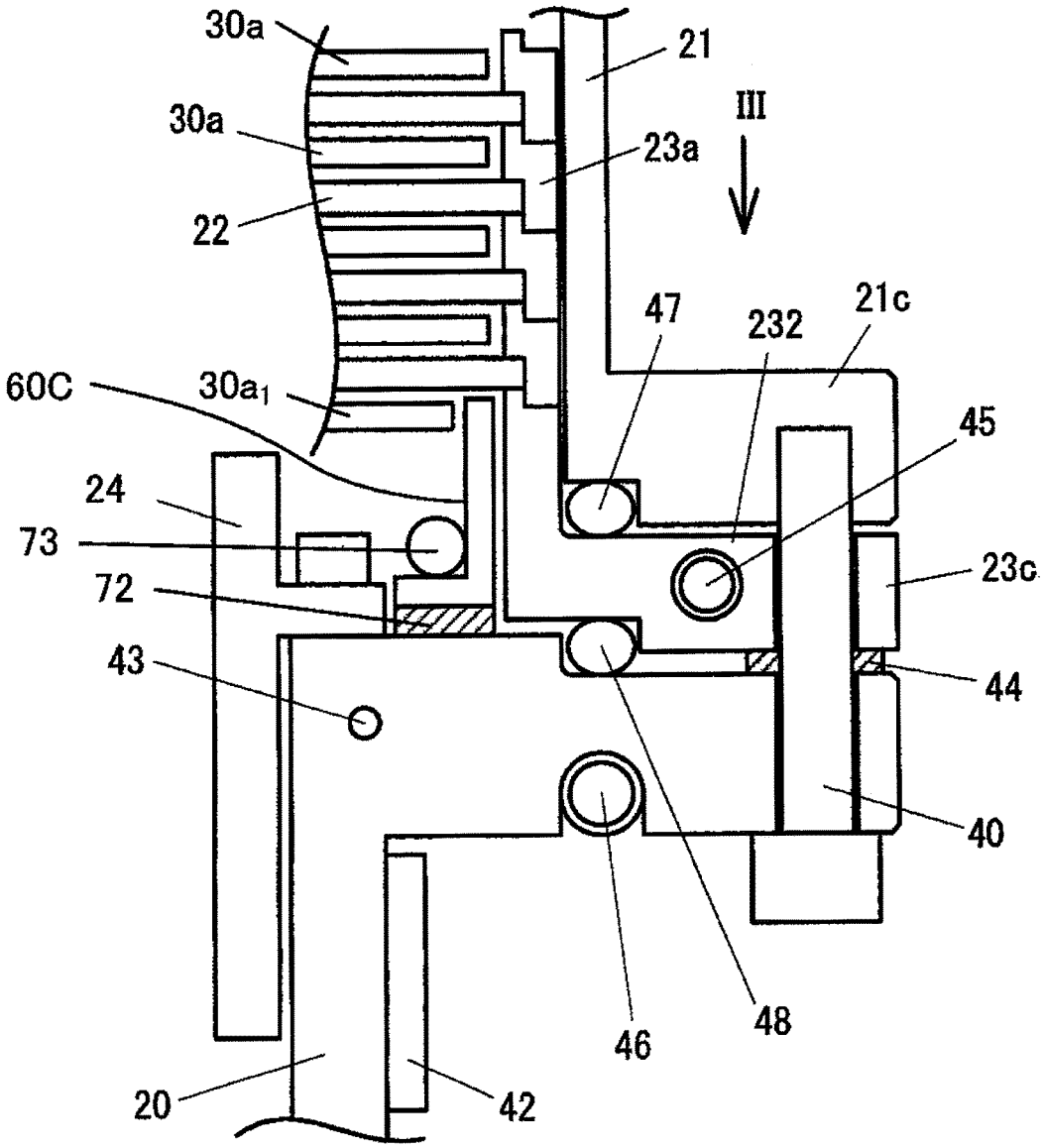
FIG. 8 is an enlarged view of an area in which a cooling spacer and an auxiliary ring are arranged in a fifth embodiment of the present invention.

FIG. 8 is an enlarged view of an area in which a cooling spacer and a heat transfer ring are arranged as the fifth embodiment of the present embodiment. In the first to fourth embodiments, heat of the base 20 is transferred to the heat transfer rings 60, 60A, and 60B. On the other hand, in the fifth embodiment, a heating ring (auxiliary ring) 60C which is heated by a heat source such as a sheathed heater is used. In a turbo-molecular pump of the fifth embodiment, as with the second embodiment, a plurality of spacers for positioning stationary blades 22 on a base 20 includes a plurality of spacers 23*a* and a cooling spacer 23*c* which bears the spacers 23*a* while supporting the bottom step stationary blade 22. The heating ring 60C is arranged on the upper surface of the base 20 with a heat insulation member 72 interposed therebetween. An annular heater, for example, a sheathed heater 73 is provided on the inner side of the heating ring 60C. The heat insulation member 72 is formed of a material having low thermal conductivity such as a resin.

The temperature of the sheathed heater 73 is controlled by a control unit 51 separately from a heater 42 which controls the temperature of a screw stator 24. Although not illustrated, it is preferred to provide a temperature sensor which detects the temperature of the auxiliary ring 60C to control the temperature of the sheathed heater 73. Alternatively, a constant current may be constantly supplied to the sheathed heater 73 when heating the base without providing a temperature sensor to thereby maintain the sheathed heater 73 at a predetermined temperature. Further, in this case, a value of the constant current supplied to the sheathed heater 73 may be changed corresponding to a temperature detected by a temperature sensor 43 which detects the temperature of the screw stator 24.

The other configurations in the fifth embodiment are the same as those of the second embodiment. Therefore, the corresponding members will be denoted by the same reference sign, and description thereof will be omitted. The turbo-molecular pump of the fifth embodiment is further provided with the sheathed heater 73 which is a heat source for heating the heating ring 60C, the insulation member 72 which thermally insulates the heating ring 60C from the base 20, and the controller which controls the sheathed heater 73 independently of the heater 42 provided in the base 20. Therefore, the fifth embodiment can achieve the same effects as achieved in the first embodiment. Further, it is possible to independently control each of the temperature of the heating ring 60C and the temperature of the screw stator 24. Therefore, the flexibility of temperature control for preventing the accumulation of a reaction product can be increased.

Further, in the first to fifth embodiments, the cooling piping system in which the three-way valve 52 is used to connect the spacer cooling pipe 45 and the base cooling pipe 46 to each other has been described as an example. However, the spacer cooling pipe 45 and the base cooling pipe 46 may be connected to each other by an on-off valve. The on-off valve is inserted between the coolant supply section 45*a* of the spacer cooling pipe 45 and an inlet port of the base cooling pipe 46, and the temperature regulation controller 511 controls opening/closing of the on-off valve. Further, the coolant discharge section 45*b* of the spacer cooling pipe 45 is bypass-connected to an outlet port of the base cooling pipe 46.

When a temperature detected by the temperature sensor 43 is less than a predetermined temperature, the temperature regulation controller 511 closes the on-off valve and turns ON the heater 42. A coolant flows thorough the spacer cooling pipe 45 to cool the rotor blades 30*a*. However, the coolant does not flow to the base cooling pipe 46, and is bypassed to the outlet port of the base cooling pipe 46. Therefore, the base cooling pipe 46 is heated by the heater 42, and the temperature of the screw stator 24 increases.

When a temperature detected by the temperature sensor 43 is equal to or higher than the predetermined temperature, the temperature regulation controller 511 turns OFF the heater 42, and opens the on-off valve. The coolant is supplied to the spacer cooling pipe 45 and the base cooling pipe 46. Therefore, the rotor blades 30*a* and the screw stator 24 are cooled.

In the above embodiments, the structure in which a spacer that is closest to the base 20, that is, the bottom step spacer 23*a* or the second spacer 23*a* from the base 20 is used as the cooling spacer 23*b*, 23*c*, or 23*d* has been described as an example. However, any of the plurality of stages of spacers can be used as the cooling spacer 23*b*, 23*c*, or 23*d*. However, it is necessary to cool the bottom step rotor blade 30*a*1 on which a reaction product is likely to be accumulated by the cooling spacer 23*b*, 23*c*, or 23*d*. As the spacer section of the cooling spacer 23*b*, 23*c*, or 23*d* is separated from the base 20, the capacity of cooling the vicinity of bottom step rotor blade 30*a*1 decreases. Therefore, the position of the cooling spacer 23*b*, 23*c*, or 23*d* is preferably closer to the base 20. Further, it is recommended that the cooling spacer 23*b*, 23*c*, or 23*d* be located on the lower side with respect to half the stages of the spacers 23*a*. For example, in a turbo-molecular pump having ten stages of spacers 23*a*, it is preferred to use a spacer 23*a* that is located lower than the fifth spacer 23*a* from the base 20 as the cooling spacer. Further, in a turbo-molecular pump having nine stages of spacers 23*a*, it is preferred to use a spacer 23*a* that is located lower than the fourth spacer 23*a* from the base 20 as the cooling spacer.

-Sixth Embodiment-

In the configuration illustrated in FIG. 2, since the bottom step stationary blade 22 is closest to the cooling spacer 23*b* among all of the stationary blades 22 on a heat path, the temperature of the bottom step stationary blade 22 is most likely to decrease and a reaction product is most likely to be accumulated on the bottom step stationary blade 22. A chlorine-based or fluorine sulfide-based reaction product has a higher sublimation temperature and becomes more likely to be accumulated, as the degree of vacuum decreases (that is, the pressure increases). As an example of the vapor pressure curve of a reaction product, FIG. 9 illustrates a vapor pressure curve L1 in the case of aluminum chloride.

Figure 9:
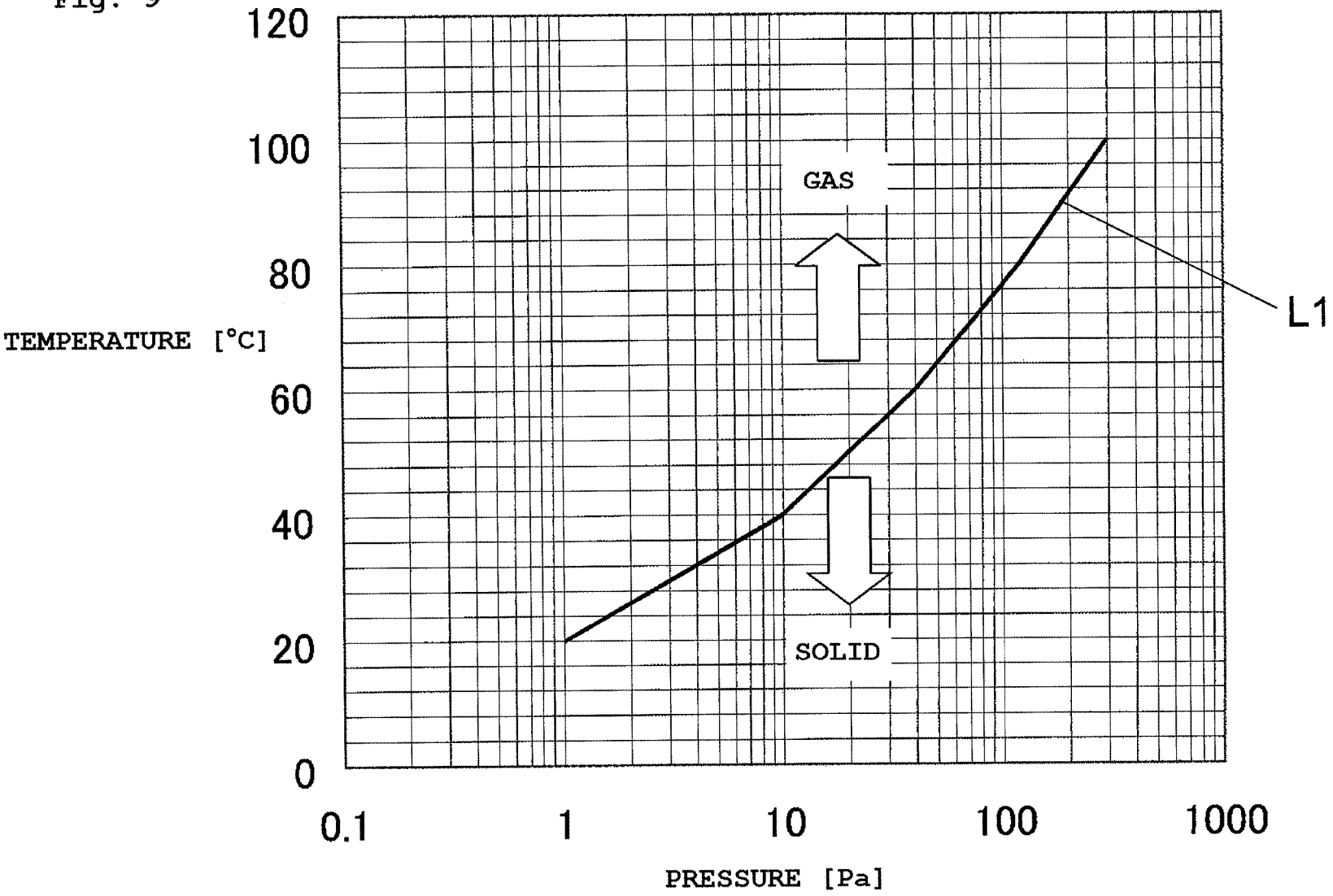
FIG. 9 is a diagram illustrating a vapor pressure curve L1 of aluminum chloride.

In FIG. 9, the vertical axis shows the sublimation temperature (° C.) and the horizontal axis shows the pressure (Pa). Aluminum chloride is in a gaseous state above the curve L1, but in a solid state below the curve L1. As can be seen from FIG. 9, since the sublimation temperature increases as the pressure increases, the reaction product is more likely to be accumulated on the more downstream side of the pump. In the above embodiments, the temperature regulation control using the heating by the heater 42 and the cooling by the cooling water inside the base cooling pipe 46 is performed to thereby prevent a reaction product from being accumulated on the screw stator 24.

Generally, the rotor 30 is formed of an aluminum alloy. A temperature at which the creep phenomenon occurs in Aluminum is lower than that in the other kinds of metal. Therefore, in a turbo-molecular pump in which the rotor 30 rotates at high speed, it is necessary to suppress the temperature of the rotor so as to be lower than the creep temperature range. Accordingly, the flow amount of gas that can be discharged by the turbo-molecular pump is restricted by the temperature of the rotor. As a result, in the temperature condition illustrated in FIG. 9, it is not possible to further increase the flow amount of gas.

In view of the above, the cooling spacer 23*b* is provide to cool the spacers 23*a* and the stationary blades 22 to improve the heat releasing performance from the rotor blades 30*a* to the stationary blades 22, thereby reducing the temperature of the rotor blades 30*a*. As a result, a margin of the temperature of the rotor blades with respect to heat generation during discharging gas becomes larger, and it is possible to increase the flow amount of gas that can be discharged.

Figure 10:
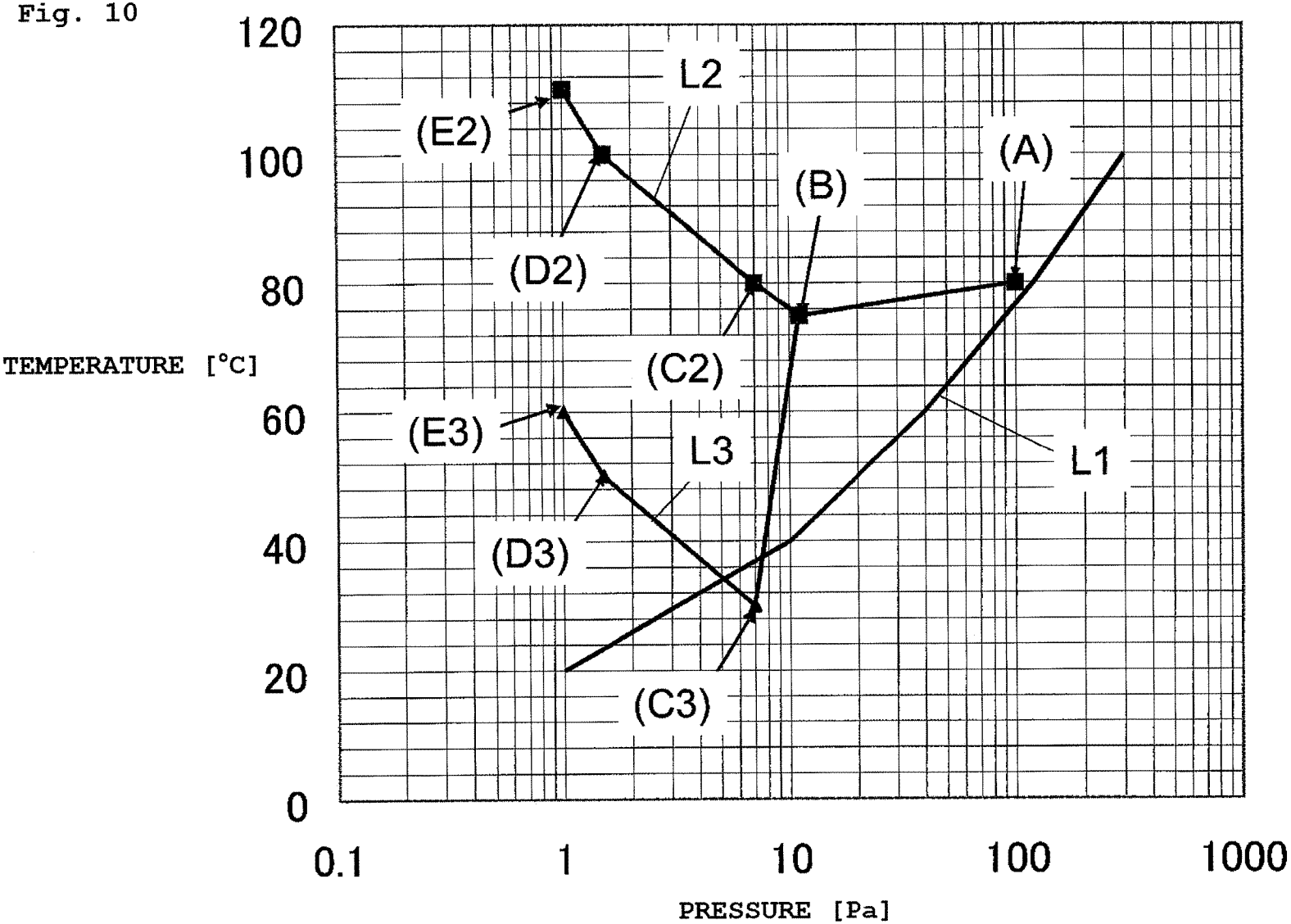
FIG. 10 is a diagram illustrating the temperature of stationary blades 22 when a cooing spacer 23*b* is not provided and the temperature of the stationary blades 22 when the cooling spacer 23*b* is provided.

FIG. 10 illustrates the temperature of the stationary blades 22 when the cooling spacer 23*b* is not provided (line L2) and the temperature of the stationary blades 22 when the cooling spacer 23*b* is provided (line L3). Further, the curve L1 (the vapor pressure curve of aluminum chloride) illustrated in FIG. 9 is also illustrated in FIG. 10. The pressure in each of the screw stator 24 and the stationary blades 22 is one during discharging gas. The line L2 is a line connecting points A, B, C2, D2, and E2 to each other. On the other hand, the line L3 is a line connecting points A, B, C3, D3, and E3 to each other.

The point A indicates data (the pressure and the temperature) at a screw stator outlet, and the point B indicates data at a screw stator inlet. The screw stator 24 is maintained at a predetermined temperature by the temperature regulation control. Therefore, the temperature at the screw stator outlet and the temperature at the screw stator inlet when the cooling spacer 23*b* is provided are the same as the temperature at the screw stator outlet and the temperature at the screw stator inlet when the cooling spacer 23*b* is not provided, respectively. Further, the temperature at the screw stator outlet (A) is slightly higher than the temperature at the screw stator inlet (B) due to heat generated by discharging gas.

On the other hand, the points C2 and C3 indicate data of the bottom step stationary blade 22, the points D2 and D3 indicate data of an intermediate stationary blade 22, and the points E2 and E3 indicate data of the highest stationary blade 22. In both of the cases of the lines L2 and L3, heat flows from the rotor blades toward the screw stator. Therefore, the stationary blade temperature becomes higher as being separated from the screw stator 24, that is, the temperature becomes lower in the order of the highest stage (E2, E3), the intermediate stage (D2, D3), and the lowest stage (C2, C3).

When the cooling spacer 23*b* is provided (line L3 ), the temperature of the stationary blades 22 totally decreases compared to the case where the cooling spacer 23*b* is not provided. In the example illustrated in FIG. 10, when a comparison is made regarding the temperature of the highest stationary blade 22, the temperature is 110° C. in the line L2, but decreases to 60° C. in the line L3 in which the cooling spacer 23*b* is provided. As a result, the temperature of the bottom step stationary blade 22 (C3) becomes lower than the vapor pressure temperature (L1) at the same pressure. As a result, as described above, a reaction product is accumulated not only on the bottom step spacer 23*a*, but also on the bottom step stationary blade 22.

Figure 11A:
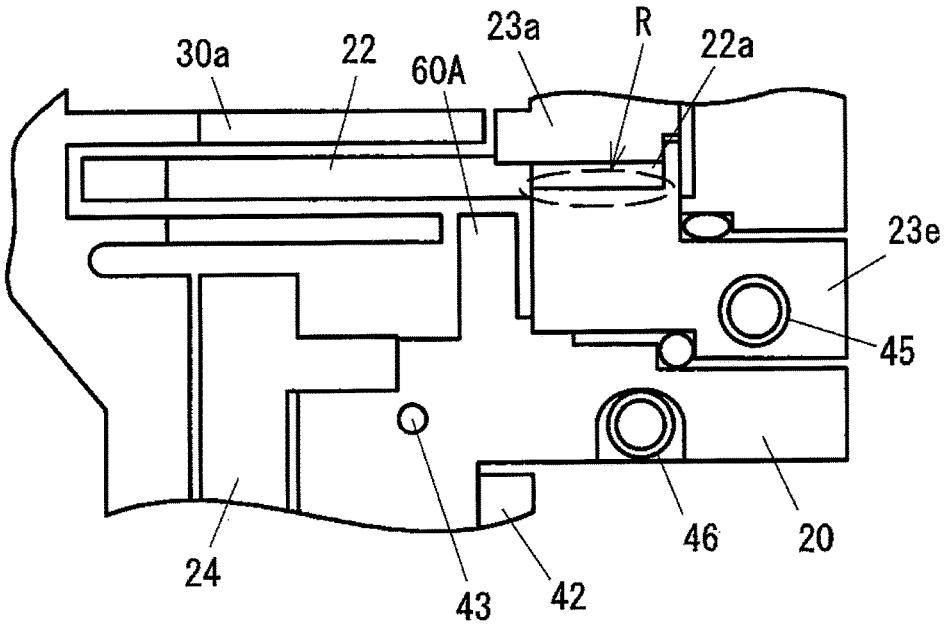
FIGS. 11A to 11C are diagrams illustrating the configuration of the lowest stationary blade 22 and a cooling spacer 23*b* in a sixth embodiment.

Therefore, in the sixth embodiment, a heat resistant section is provided in a contact region R between the bottom step stationary blade 22 and a cooling spacer 23*e* of FIG. 11A. The heat resistant section suppresses heat from flowing to the cooling spacer 23*e* from the bottom step stationary blade 22. FIG. 11A is an enlarged view of apart in which the cooling spacer 23*e* is provided. Also in the present embodiment, a heat transfer ring 60A is provided on the inner peripheral side of the cooling spacer 23*e*. The heat transfer ring 60A constitutes a part of the base 20. However, the present invention is not limited thereto, and the heat transfer ring 60A may not be provided. In the configuration illustrated in FIGS. 11A to 11C, the bottom step stationary blade 22 is sandwiched between the bottom step spacer 23*a* and the cooling spacer 23*e*. In the configuration illustrated in FIG. 2, the stationary blade 22 is not sandwiched between the bottom step spacer 23*a* and the cooling spacer 23*b*. However, the cooling spacer 23*e* corresponds to one formed by integrating the cooling spacer 23*b* and the bottom step spacer 23*a* of FIG. 2 to each other.

Figure 11B:
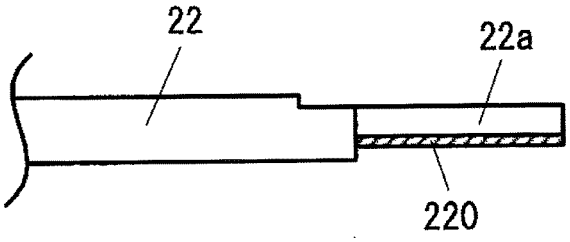
Figure 11C:
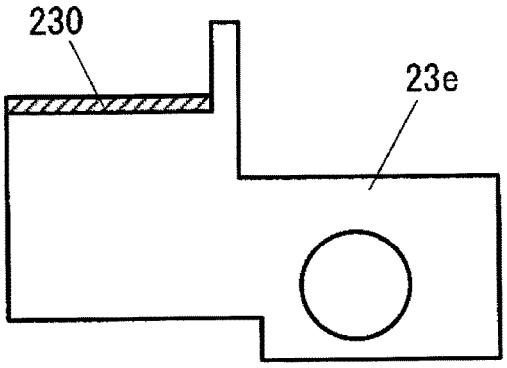

FIG. 11B is a diagram illustrating a case where a heat resistant section 220 is provided in the stationary blade. The heat resistant section 220 is provided in a contact region in the bottom step stationary blade 22, specifically, the lower surface (a surface making contact with the cooling spacer 23*e*) of an outer rib section 22*a* which is sandwiched between the cooling spacer 23*e* and the bottom step spacer 23*a*. Alternatively, instead of the heat resistant section 220 on the stationary blade 22, a heat resistant section 230 may be provided in the cooling spacer 23*e* as illustrated in FIG. 11C. The heat resistant section 230 is arranged on a surface of the cooling spacer 23*e*, the surface making contact with the outer rib section 22*a* of the stationary blade 22. Further, both of the heat resistant sections 220 and 230 may be provided.

Examples of the heat resistant sections 220 and 230 are as follows. For example, when the material of the stationary blades 22 and the cooling spacer 23*e* is an aluminum alloy, alumite treatment is applied onto the surface of the material, and the formed alumite layer is used as the heat resistant sections 220 and 230. An alumite layer has a lower thermal conductivity than an aluminum alloy, and therefore functions as a heat resistant section. Further, instead of the alumite treatment, a resin such as an epoxy resin may be applied onto the contact surface, and the formed resin layer may be used as the heat resistant sections 220 and 230.

Further, a stainless alloy may be used as the material of the bottom step stationary blade 22 or the cooling spacer 23*e* to thereby suppress heat from flowing to the cooling spacer 23*e* from the stationary blade 22. The other stationary blades 22 than the bottom step one are formed of a metal material of an aluminum alloy. However, by forming the bottom step stationary blade 22 using a stainless alloy having a lower thermal conductivity, it is possible to suppress heat from flowing to the cooling spacer 23*e* from the bottom step stationary blade 22. The same is true when the cooling spacer 23*e* is formed of a stainless alloy. Further, the bottom step stationary blade 22 or the cooling spacer 23*e* may be formed of a stainless alloy, and a resin such as an epoxy resin may be further applied onto the contact surface thereof.

Figure 12:
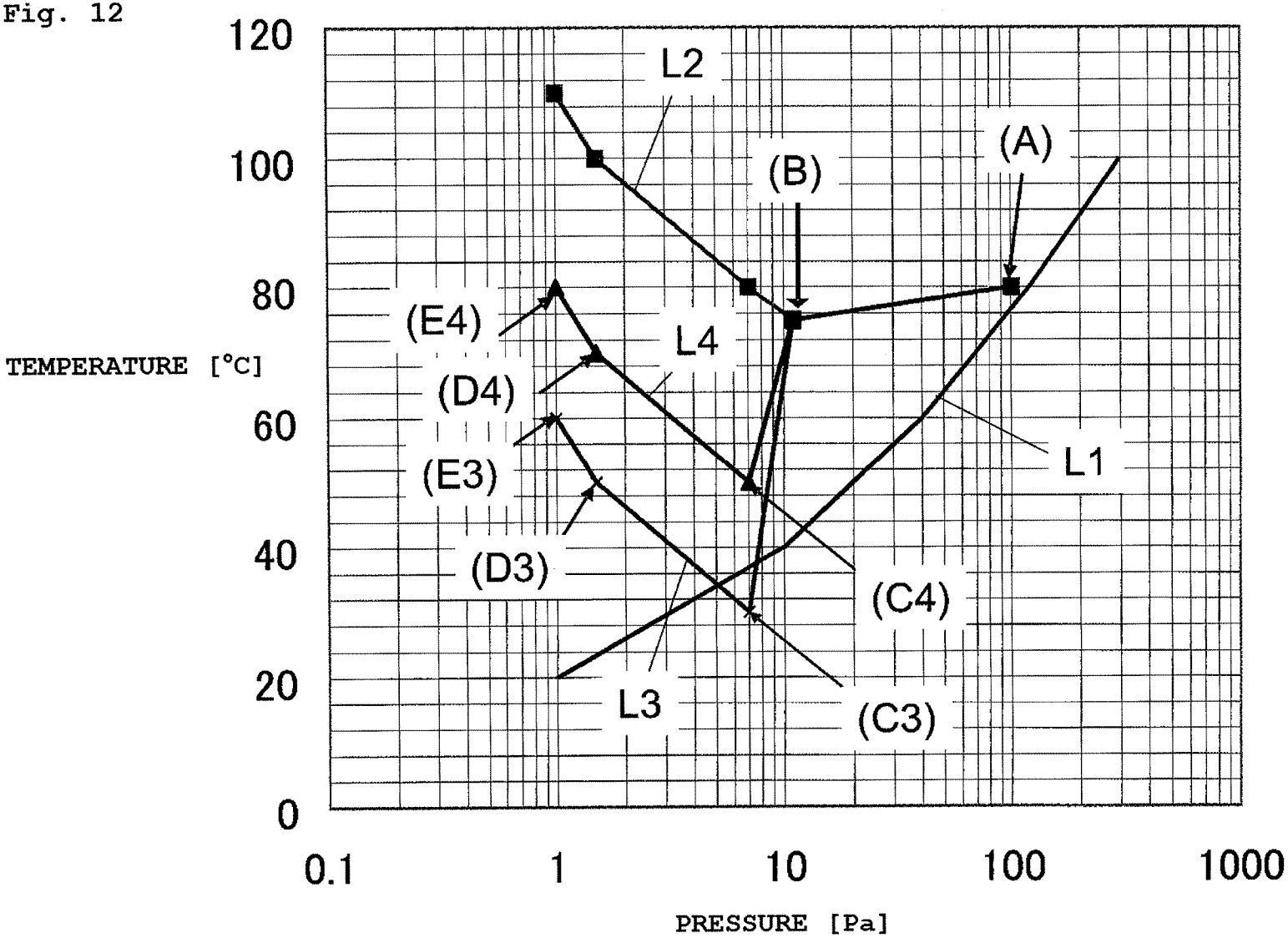
FIG. 12 is a diagram explaining the effect of heat resistant sections 220 and 230.

As illustrated in FIGS. 11A to 11C, by providing the heat resistant section 220 or the heat resistant section 230 in the contact region R, heat is suppressed from flowing to the cooling spacer 23*e* from the bottom step stationary blade 22, and the stationary blade temperature increases as indicated by a line L4 of FIG. 12. The temperature of the screw stator 24 is the same as that in the case of the lines L1 and L2 due to the temperature regulation control. However, since the heat resistant section 220 or 230 is provided, the amount of heat flowing from the stationary blades 22 to the cooling spacer 23*e* decreases. Therefore, the temperature of each of the stationary blades 22 increases compared to the case where the heat resistant section is not provided (line L3), and the temperature of the bottom step stationary blade 22 (C4) becomes higher than the temperature of the vapor pressure curve L1 at the same pressure. As a result, it is possible to suppress the accumulation of a reaction product on the bottom step stationary blade 22.

In the example described above, the alumite treatment is applied only onto the lower surface of the outer rib 22*a* of the stationary blade 22. However, the alumite treatment may be applied to the entire surface of the stationary blade 22. Also in this case, the same effect as achieved in the case where the alumite treatment is applied only onto the lower surface can be achieved. Further, when the alumite treatment is applied onto the entire surface of the stationary blade 22, the emissivity on the stationary blade surface increases. Therefore, heat transfer by radiation from the rotor blades 30*a* to the stationary blades 22 is improved, and the rotor blade temperature (that is, the rotor temperature) can be reduced. On the contrary, the temperature of the bottom step stationary blade 22 becomes higher than that in the case illustrated in FIG. 12.

Figure 13:
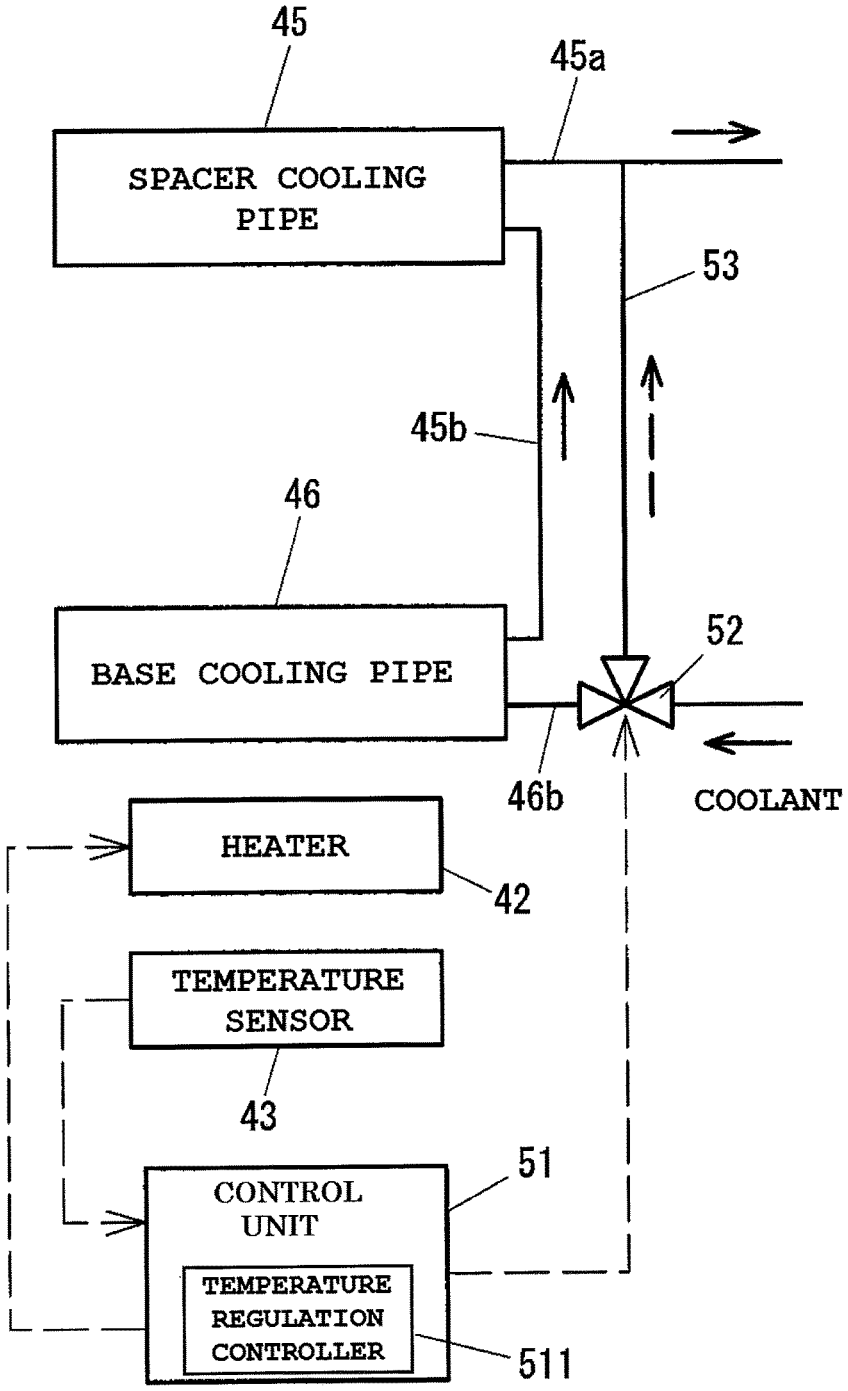
FIG. 13 is a diagram illustrating another configuration of the cooling system.

Further, by employing the configuration of a cooling system as illustrated in FIG. 13, it is possible to further increase the temperature of each of the stationary blades 22 compared to the case of FIG. 12 (when the cooling system of FIG. 4 is employed). FIG. 13 is a block diagram illustrating another example of the temperature regulation system and the cooling system illustrated in FIG. 4. In comparison with the configuration of FIG. 4, the arrangement of the three-way valve 52 and the connection of the cooling system differ from those of FIG. 4. In the example illustrated in FIG. 4, the spacer cooling pipe 45 is arranged on the upstream side of the flow of the coolant, the three-way valve 52 is arranged between the spacer cooling pipe 45 and the base cooling pipe 46, and the bypass pipe 53 for the base cooling pipe 46 is provided.

On the other hand, in the example illustrated in FIG. 13, the base cooling pipe 46 is arranged on the upstream side of the flow of a coolant, the three-way valve 52 is arranged on the upstream side of the base cooling pipe 46, and the bypass pipe 53 is provided to bypass the base cooling pipe 46 and the spacer cooling pipe 45. That is, the bypass pipe 53 is connected in parallel to the spacer cooling pipe 45 and the base cooling pipe 46 which are connected in series.

Figure 14:
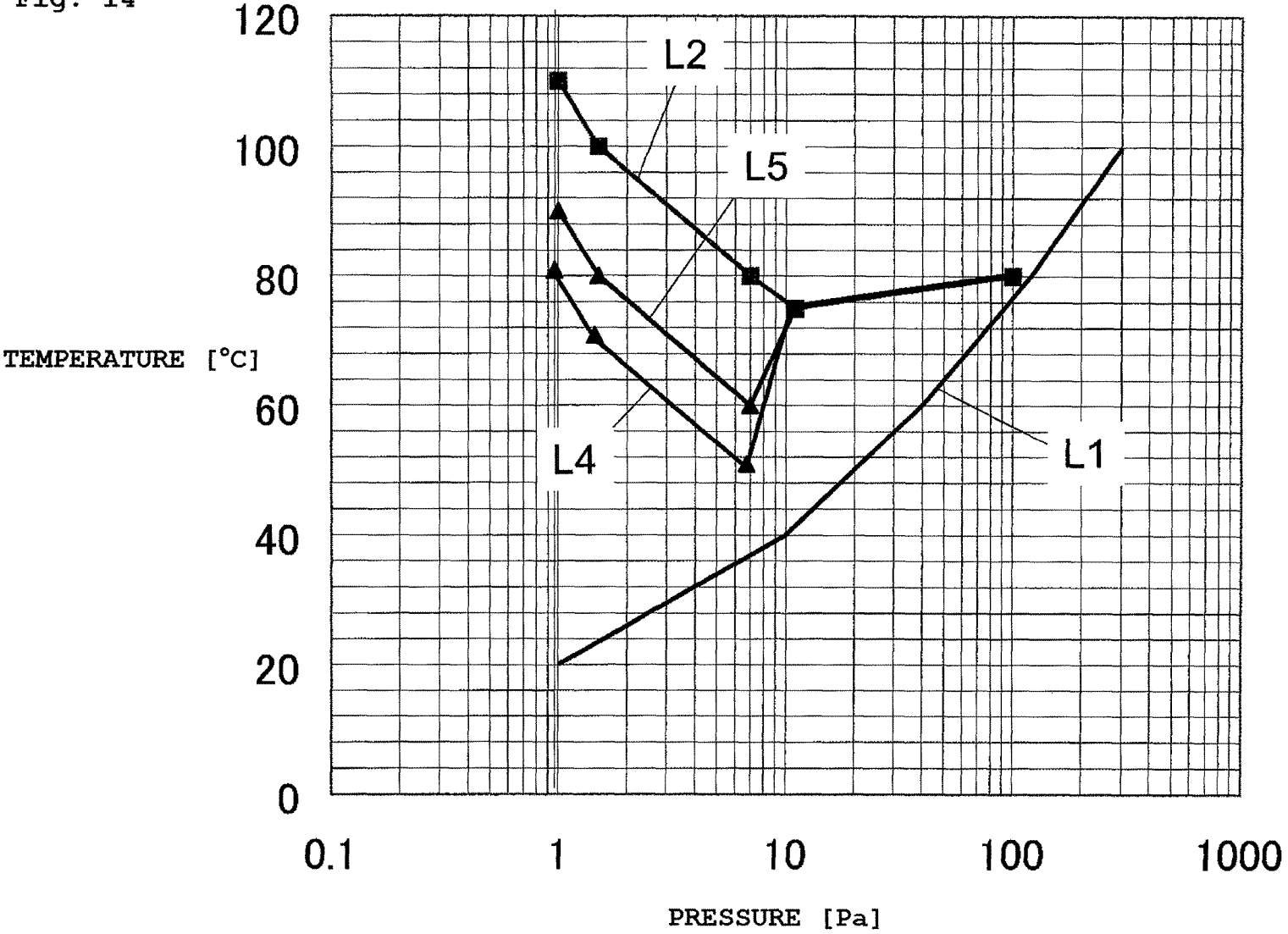
FIG. 14 is a diagram illustrating the temperature of each stationary blade 22 when employing the cooling system of FIG. 13.

By switching the three-way valve 52, the coolant is supplied to either one of a path of the spacer cooling pipe 45 and the base cooling pie 46 connected in series, or the bypass pipe 53. Control for the three-way valve 52 during temperature regulation is the same as that in the case of FIG. 4. In the configuration illustrated in FIG. 13, a coolant heated by the base cooling pipe 46 is supplied to the spacer cooling pipe 45. Therefore, the temperature of the coolant supplied to the cooling spacer 23*e* is higher than that in the configuration illustrated in FIG. 4. As a result, as indicated by a line L5 illustrated in FIG. 14, the temperature of each of the stationary blades 22 further increases. When the temperature of each of the stationary blades 22 is maintained further higher relative to the line L1 in this manner, although the flow amount of gas that can be supplied decreases, it is possible to further suppress the accumulation of a reaction product on the stationary blades 22 (especially, on the bottom step stationary blade 22). As a result, the maintenance interval can be made longer.

In the above embodiments, when the flow of a coolant in the base cooling pipe 46 and the spacer cooling pipe 45 is stopped during the temperature regulation control, the coolant is diverted to the bypass pipe 53 using the three-way valve 52. Therefore, it is possible to prevent the coolant from stopping flowing in the cooling system of the entire apparatus. Generally, in a vacuum apparatus provided with a cooling system using a coolant, an alarm is generated when the flow of the coolant stops. However, when using the turbo-molecular pump of the present embodiment, an alarm is not generated during the temperature regulation. Of course, a two-way valve may be used instead of the three-way valve to allow a coolant to flow and stop. Further, in the above embodiment, the cooling spacer 23*e* and the heat resistant section are provided in the turbo-molecular pump which performs the temperature regulation control using the heating by the heater 42 and the cooling by the coolant in the base cooling pipe 46. However, the cooling spacer 23*e* and the heat resistant section may be provided in a turbo-molecular pump having no temperature regulation system.

Further, a turbo-molecular pump obtained by appropriately combining the above embodiments may be employed.

In the above embodiments, the heat transfer ring is interposed between the bottom step rotor blade and the cooling spacer or the spacer. However, the heat transfer ring may be omitted, and a reaction product accumulation prevention layer may be provided on the vacuum side surface of the cooling spacer or the spacer in the following manner. Referring to FIG. 5 of the second embodiment, a heat insulation layer which is made of a resin or the like and a metal layer which covers the heat insulation layer are formed on the vacuum side surface of the heat transfer ring 60A. Metal used in the metal layer is preferably one having a smaller thermal conductivity than an aluminum alloy which is the material of the spacers such as SUS. The main body section of the heat transfer ring 60A is cooled by a coolant flowing in the cooling pipe 45. The vacuum side surface is maintained at a temperature higher than the temperature of the spacer main body section, that is, equal to or higher than the sublimation temperature of reactive gas by virtue of the heat insulation layer. Therefore, the material and the thickness of each of the heat insulation layer and the metal layer are set so as to maintain the temperature of the vacuum side surface equal to or higher than the sublimation temperature of the reactive gas.

What is claimed is:

1. A turbo-molecular pump comprising:

a rotor having a plurality of stages of rotor blades and a cylindrical section;

a plurality of stages of stationary blades alternately arranged with respect to the rotor blades;

a stator arranged with a gap from the cylindrical section, the stator together with the cylindrical section constituting a screw groove pump section;

a plurality of spacers stacked on a base, the spacers including at least one cooling spacer having a cooling section;

a heater heating the stator;

a temperature regulation section controlling the heater to regulate the temperature of the stator so as to be a reaction product accumulation prevention temperature; and an auxiliary ring for reaction product accumulation prevention at least a part of which is located in a space between the spacer facing a bottom step rotor blade, and the bottom step rotor blade, the space being within a plane of the bottom step rotor blade.

2. The turbo-molecular pump according to claim 1, wherein the auxiliary ring is formed separately from the base and in contact with the base so that heat of the base is transferred thereto, or the auxiliary ring is integrally formed with the base or the stator.

3. The turbo-molecular pump according to claim 1, wherein the auxiliary ring is arranged separated from the spacer facing the bottom step rotor blade.

4. The turbo-molecular pump according to claim 1, wherein the auxiliary ring has a layer which is formed on a surface facing the rotor blade and increases the heat absorption.

5. The turbo-molecular pump according to claim 1, further comprising:

a heat source heating the auxiliary ring;

a heat insulation member thermally insulating the auxiliary ring from the base; and controller controlling the heat source independently of the heater.

6. The turbo-molecular pump according to claim 1, further comprising:

a spacer cooling passage provided in the cooing section of the at least one cooling spacer; and a base cooling passage cooling the base, wherein a coolant is supplied to the spacer cooling passage, and the coolant flows into the base cooling passage through the spacer cooling passage.

7. A turbo-molecular pump comprising:

a rotor having a plurality of stages of rotor blades and a cylindrical section;

a plurality of stages of stationary blades alternately arranged with respect to the rotor blades;

a stator arranged with a gap from the cylindrical section, the stator together with the cylindrical section constituting a screw groove pump section; and a plurality of spacers stacked on a base, the spacers including a bottom step cooling spacer having a cooling section; wherein on at least one of a contact surface of the bottom step stationary blade supported by the cooling spacer, the contact surface making contact with the cooling spacer, and a contact surface of the cooling spacer, the contact surface making contact with the bottom step stationary blade, a heat resistant section suppressing heat transfer from the bottom step stationary blade to the cooling spacer is provided.

8. The turbo-molecular pump according to claim 7, wherein the bottom step stationary blade is formed of an aluminum alloy, and alumite treatment is applied onto a surface of the bottom step stationary blade, the surface including at least the contact surface, to form the heat resistant section, and/or the cooling spacer is formed of an aluminum alloy, and alumite treatment is applied onto a surface of the cooling spacer, the surface including at least the contact surface, to form the heat resistant section.

9. The turbo-molecular pump according to claim 7, wherein the heat resistant section provided on the contact surface of the bottom step stationary blade or the contact surface of the cooling spacer is formed of a resin material.

10. The turbo-molecular pump according to claim 7, further comprising:

a heater heating the stator;

a temperature regulation section controlling the heater to regulate the temperature of the stator so as to be a reaction product accumulation prevention temperature;

a spacer cooling passage provided in the cooling section of the cooling spacer; and a base cooling passage cooling the base, wherein a coolant is supplied to the base cooling passage, and the coolant flows into the spacer cooling passage through the base cooling passage.

* * * * *